US005588276A

United States Patent [19]

Terjung et al.

[11] Patent Number: 5,588,276

[45] Date of Patent: Dec. 31, 1996

[54] SLEEVING MACHINE

[76] Inventors: Herman F. Terjung, 412 N. Exeter St., Baltimore, Md. 21202; David P. Crum, 4207 Kolb Ave., Baltimore, Md. 21206

[21] Appl. No.: 349,433

[22] Filed: Dec. 5, 1994

Related U.S. Application Data

[63] Continuation-in-part of Ser. No. 25,843, Mar. 3, 1993, Pat. No. 5,379,570.

[51] Int. Cl.[6] ..... B65B 13/02; B65B 19/18; B65B 57/06; B65B 57/18

[52] U.S. Cl. ..... 53/399; 53/458; 53/169; 53/566; 53/585; 53/259; 53/505; 53/508

[58] Field of Search ..... 53/169, 176, 566, 53/585, 399, 458, 459, 255, 258, 259, 508, 505, 64, 77

[56] References Cited

U.S. PATENT DOCUMENTS

| | | | |
|---|---|---|---|
| 1,407,581 | 2/1922 | Rose . | |
| 1,473,496 | 11/1923 | Molins . | |
| 1,981,463 | 11/1934 | Nejedly | 53/169 |
| 2,966,020 | 12/1960 | Bacsak | 53/169 |
| 3,293,825 | 12/1966 | Schermund . | |
| 3,299,610 | 1/1967 | Webster | 53/169 |
| 3,455,086 | 7/1969 | Bescript et al. | 53/169 |
| 3,476,023 | 11/1969 | Fuller et al. | 53/169 |
| 3,665,674 | 5/1972 | Bivans et al. | 53/566 X |
| 3,728,945 | 4/1973 | Vuilleumier . | |
| 3,818,676 | 6/1974 | Russell et al. | 53/169 X |
| 4,012,887 | 3/1977 | Calvert et al. . | |
| 4,693,055 | 9/1987 | Olsen, Jr. et al. . | |
| 4,730,437 | 3/1988 | Benno | 53/399 |
| 4,835,944 | 6/1989 | Herrin | 53/485 |
| 4,869,052 | 9/1989 | Calvert | 53/566 |
| 4,926,616 | 5/1990 | Zielke et al. | 53/585 |
| 4,998,910 | 3/1991 | Mohaupt et al. | 53/566 X |

*Primary Examiner*—Linda Johnson
*Attorney, Agent, or Firm*—Leonard Bloom

[57] ABSTRACT

A sleeving machine and a method for automatically inserting a tray of postal mail into a sleeve. The tray is disposed on a transport station and advanced by a transport belt. A pusher on the transport belt engages the tray for advancement through the machine. Collapsed sleeves are dispensed as required from a hopper into a sleeving station. A suction head and a pivoted second side of the sleeving station open the sleeve to receive the tray. The transport belt with the pusher advances the tray into the open sleeve and then advances the sleeve, with the tray therein, out of the sleeving station. Sensors are provided to control and coordinate movement of the second belt and dispensing of the sleeves from the hopper into the sleeving station. Safety features are provided.

23 Claims, 14 Drawing Sheets

SLEEVING MACHINE

CROSS REFERENCE TO RELATED APPLICATION

This application is a continuation-in-part of application Ser. No. 08/025,843, filed Mar. 3, 1993, which issued as U.S. Pat. No. 5,379,570, Jan. 10, 1995 the disclosure of which is incorporated by reference herein in its entirety.

FIELD OF THE INVENTION

The present invention relates to a sleeving machine and a method for automatically inserting a tray of postal mail with a sleeve and, more particularly, to the machine and method which automatically dispenses and opens collapsed sleeves, advances and inserts therein the tray and advances the sleeve containing the tray from the machine.

BACKGROUND OF THE INVENTION

The postal service has directed considerable resources to improving the sorting and delivery of letters and related postal matters. Automated scanners sort mail by zip code and automatic equipment is available for transporting the mail within the separate postal stations. As part of this concept the postal service employs a system in which mail, such as letters addressed to a single destination (e.g., one zip code), is placed in a marked tray. In order to prevent loss of the individual letters, or the introduction of letters for an alternate destination, the tray is inserted into an open-ended sleeve. Thus, the tray in the sleeve is easily transported. The insertion of the tray into the sleeve is presently being performed manually which is inefficient, slow and labor intensive and is a portion of the overall mail handling approach which is urgently in need of improvement.

An apparatus for inserting articles into open-ended receptacles is disclosed in U.S. Pat. No. 1,407,581 issued to Rose Feb. 21, 1922. Outer members are fed into the apparatus in a collapsed condition by a pair of arm-like pushers and opened by a wedge-shaped member. A reciprocatable slider thrusts the inner member into the outer member. U.S. Pat. No. 3,299,610 issued to Webster Jan. 24, 1967 discloses an apparatus for filling sleeve packages wherein a carton or sleeve is erected at the sleeving station with an open end thereof directed along the path of a package which is moving along a predetermined path toward the sleeving station. The carton or sleeve is held stationary by suction applied to the underside of the sleeve while the package is pushed into the open end of the carton or sleeve. U.S. Pat. No. 4,012,887 issued to Calvert Mar. 22, 1977 discloses a packaging machine which withdraws collapsed sleeve-type containers from a hopper by suction means applied to the bottom of the sleeve and sets up the sleeve to receive bottles through the open end. End flaps are closed on the sleeve. U.S. Pat. No. 4,693,055 issued to Olsen, Jr. et al Sep. 15, 1987 disclose a machine for feeding beverage cans to open-ended carrier sleeves. U.S. Pat. No. 4,869,052 issued to Calvert Sep. 26, 1989 discloses a packaging machine. Collapsed sleeve-type articles are withdrawn in sequence from a hopper by suction cup means which then holds each carton at a loading station while a plurality of articles are inserted through an open end of each container. Flaps for the open ends of the container are then closed.

Although the packaging machines are useful for the purposes for which they were designed, a simpler, more efficient sleeving machine is needed for the postal service requirements.

SUMMARY OF THE INVENTION

Accordingly, it is a primary object of the present invention to provide a sleeving machine which efficiently and automatically inserts a tray into an opened sleeve.

It is a further object of the present invention to provide sleeves individually, to open the sleeves automatically and to coordinate insertion of trays into sleeves in a continuous and uninterrupted manner.

In accordance with the teachings of the present invention, there is disclosed a sleeving machine for automatically inserting a tray of postal mail into a sleeve. The sleeve has a top, a bottom, two sides therebetween and two open ends. The sides each have a height. The machine includes a transport station having a continuous transport means disposed longitudinally therein to move the tray. A sleeving station having a base surface, a first side, an opposite second side, an entrance end and an exit end, the entrance end being adjacent to the transport station. The sleeving station communicates with the transport station. The transport means extends longitudinally through the sleeving station for advancing the tray in a direction from the entrance end to the exit end. A hopper adjoins the first side of the sleeving station, the hopper containing therein a plurality of collapsed sleeves. Means are provided for dispensing the collapsed sleeves one at a time as desired, into the sleeving station. A source of vacuum is provided. A suction head is interruptedly connected to the source of vacuum. The suction head is adjustably disposed above the sleeving station for engaging the top of the collapsed sleeve and for opening the collapsed sleeve wherein the open ends of the sleeve are oriented in the direction of movement of the tray such that the tray may be advanced and disposed inside the opened sleeve.

In further accordance with the teachings of the present invention, a method is disclosed for automatically .inserting a tray of postal mail into a sleeve.

These and other objects of the present invention will become apparent from a reading of the following specification, taken in conjunction with the enclosed drawings.

DESCRIPTION OF THE PREFACED EMBODIMENT

Figure 1:
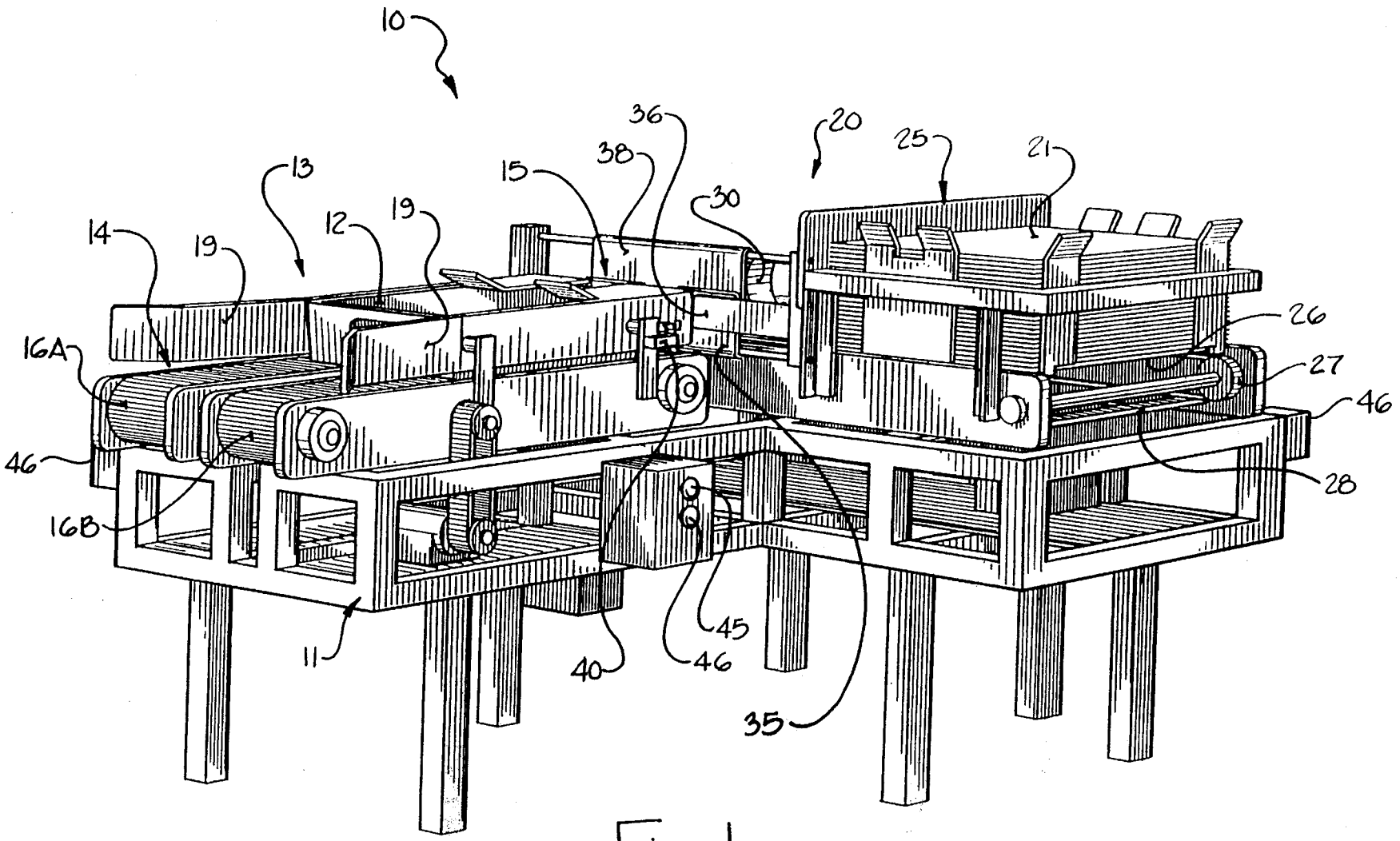
FIG. 1 is a perspective view of the sleeving machine of the present invention.
Figure 2:
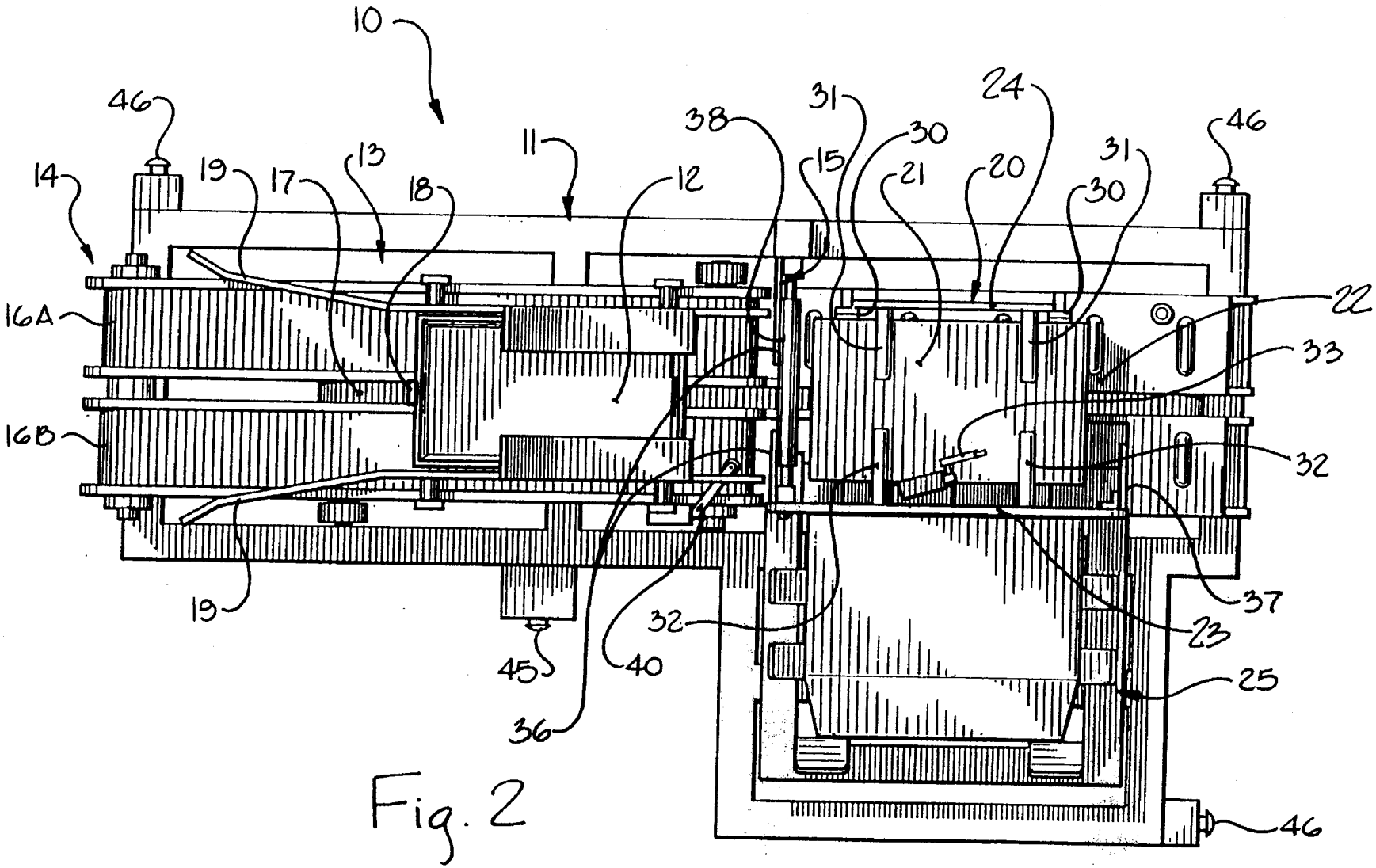
FIG. 2 is a top plan view of the sleeving machine of FIG, 1.
Figure 3:
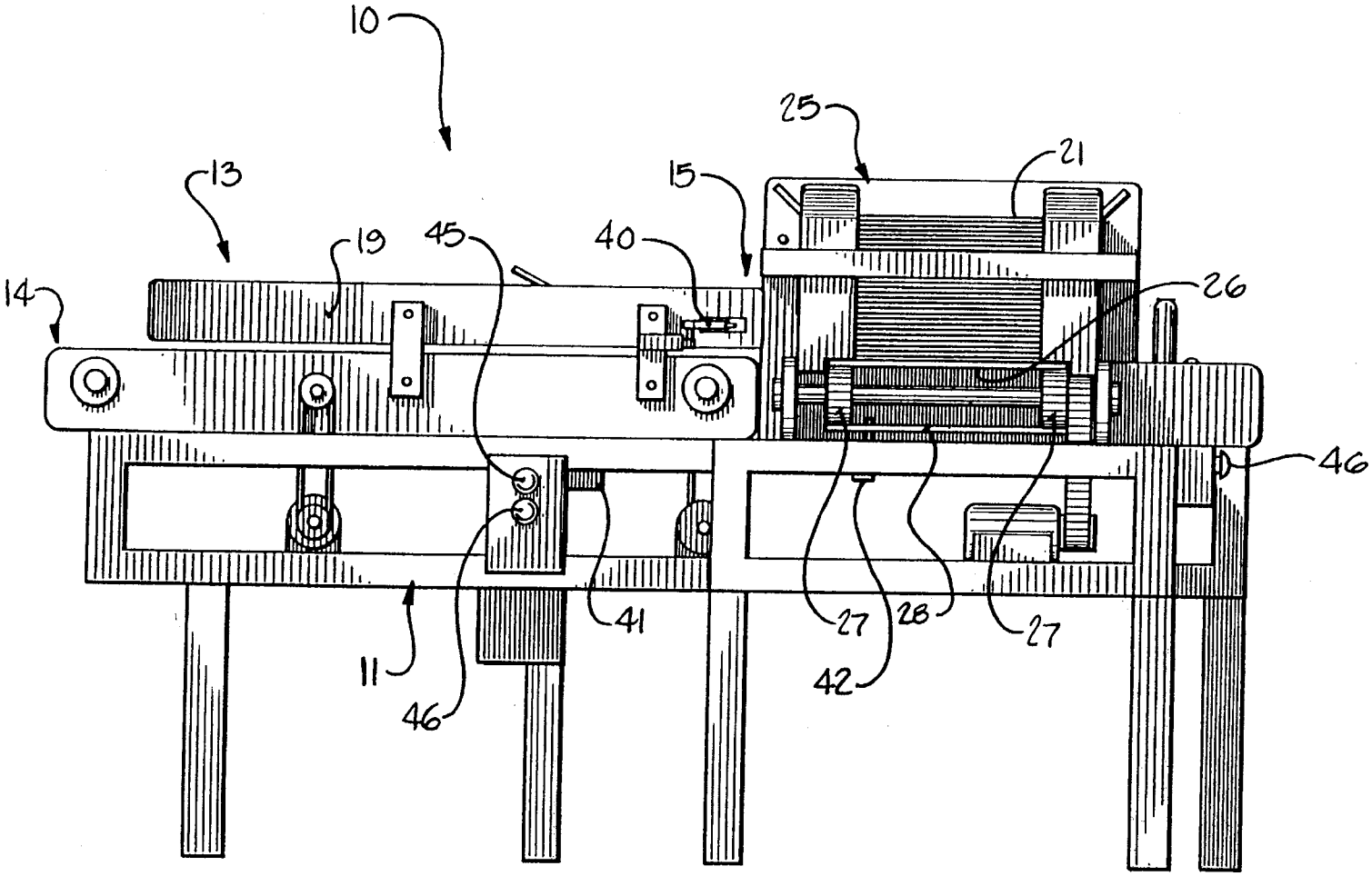
FIG. 3 is a side elevation view of the sleeving machine of FIG. 1.
Figure 4:
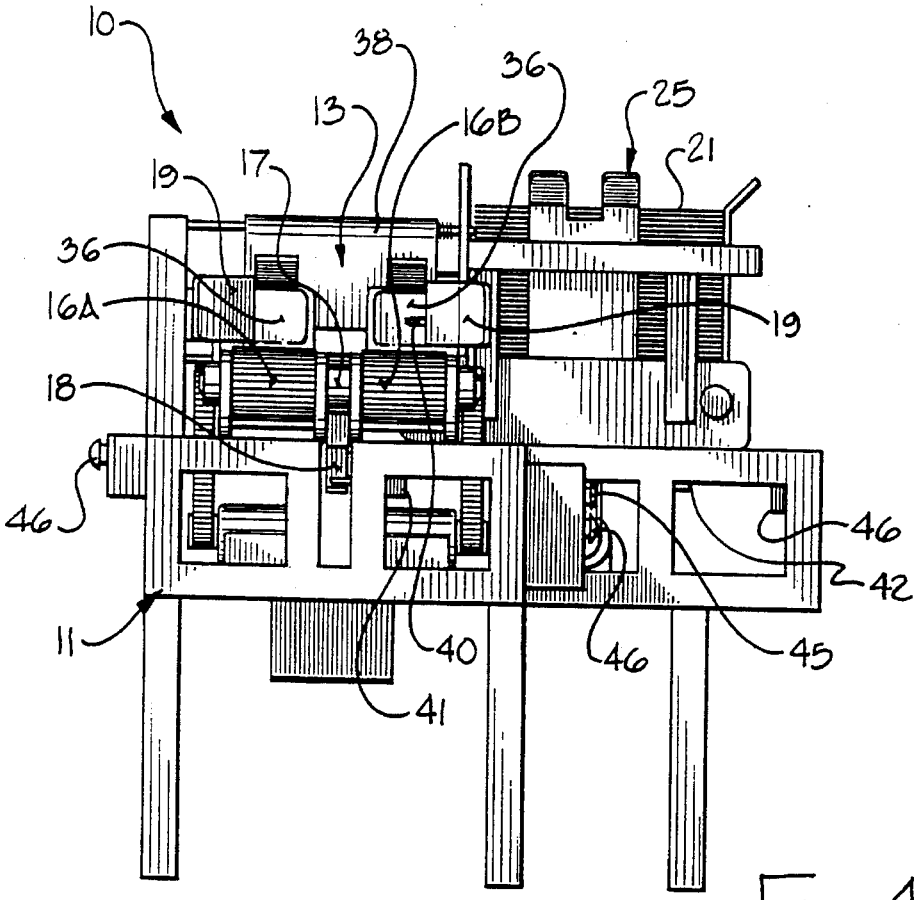
FIG. 4 is a front elevation view of the sleeving machine of FIG. 1.
Figure 5:
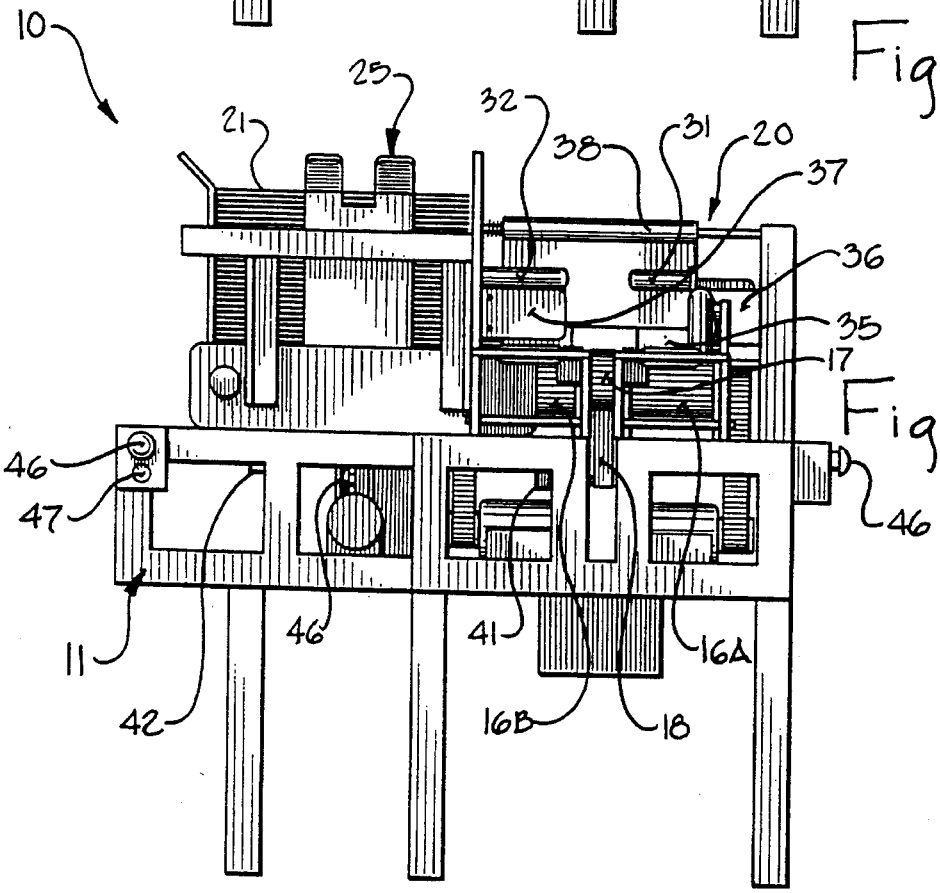
FIG. 5 is a back elevation view of the sleeving machine of FIG. 1.

Referring now to FIGS. 1–6 the sleeving machine 10 includes a frame 11 having legs which can be adjusted to provide an overall height of the machine ranging from 32 inches to 42 inches. If desired the frame may be mounted on industrial grade casters to permit moving the sleeving machine 10 by just one person.

The tray 12 used with the sleeving machine 10 is formed of fiberboard or plastic and is commonly used by the postal service. The tray 12 has a bottom approximately 22 inches long and 10¼ inches wide. The tray 12 is approximately 4¾ inches in height. The tray 12 has two sidewalls and two ends, the sidewalls and ends are slanted outwardly from the bottom so that the top of the tray 12, which is open, is approximately 25 inches long and 11½ inches wide. The letters or other postal mail is placed in the open top of the tray 12 and when so loaded, the tray 12 and mail have an average weight of 17.5 lbs. Trays of larger and smaller dimensions may be used with the machine.

The tray 12 with postal mail therein is placed on a transport station 13 of the sleeving machine 10 which is on the top of the frame 11. The transport station 13 has a first (or entrance) end 14 and a second (or exit) end 15 with first and second sides substantially perpendicular to the ends 14, 15. A transport means 16 is disposed between the sides of the transport station 13. The transport means 16, preferably is continuous in that it is in the form of an endless loop. This transport means 16 may be one or more belts, chains, conveyors or other systems which are capable of being driven to advance the tray 12 as is described. The transport means 16 preferably being a pair of spaced-apart belts 16A, 16B, each belt being a continuous belt or conveyor. The transport means 16 is power driven and is driven without interruption as long as power is provided to the sleeving machine 10. An on-off switch is provided as will be described. The transport means 16 extends between the first end 14 and the second end 15 of the transport station 13. The transport means 16 conveys the tray 12 through the transport station 13. A second transport means 17 is disposed in the space between the pair of belts 16A, 16B of the transport means 16 and extends beyond the transport station 13 as will be described. The second transport means 17 is a continuous belt, chain, conveyor or other means and is power driven. The second transport means 17 is disposed on an approximate center line of the transport station 13. The second transport means 17 may be separate from the transport means 16 or, if desired, may be the same belt, chain, conveyor or other means extending uninterruptedly through the sleeving machine 10.

Figure 7:
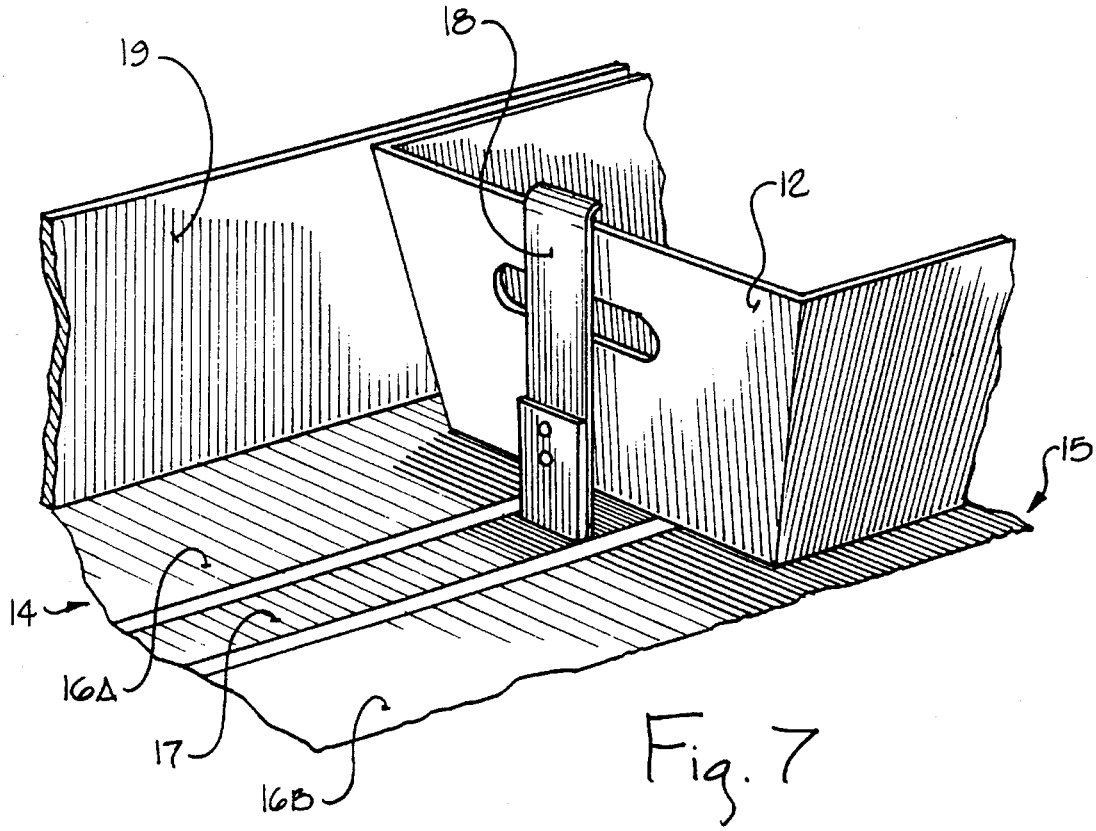
FIG. 7 is a perspective view showing the pusher means engaging the tray.
Figure 8:
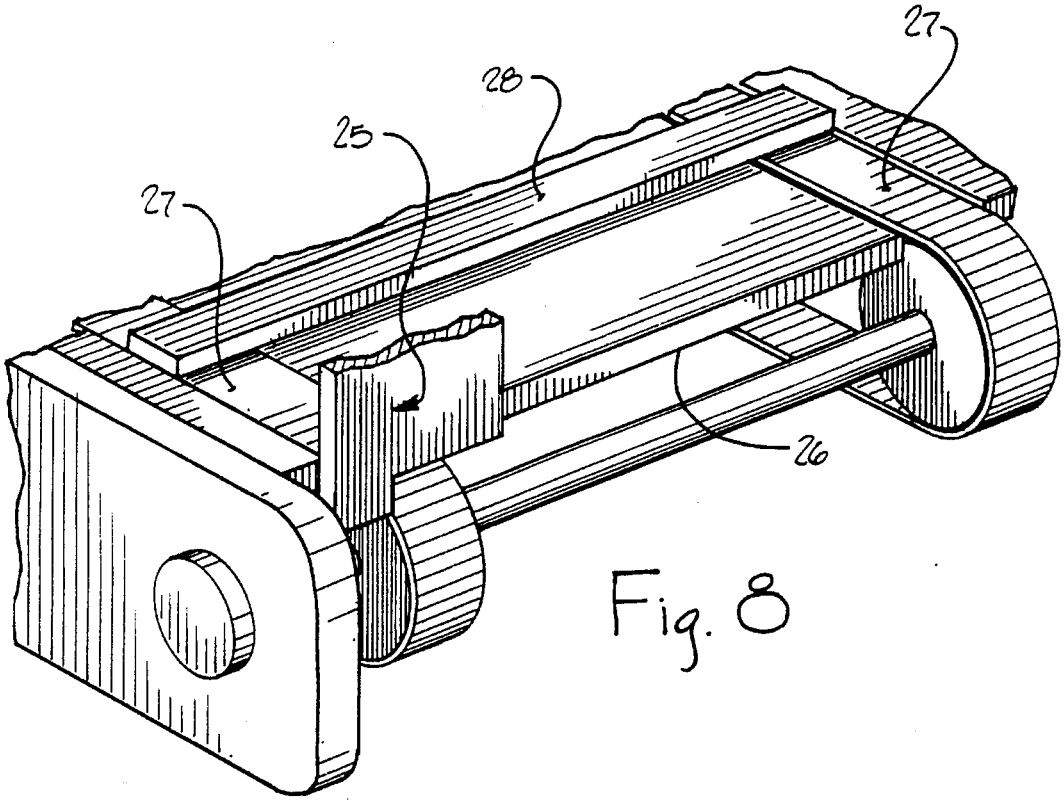
FIG. 8 is a perspective view showing means for dispensing the collapsed sleeve from the hopper.
Figure 9:
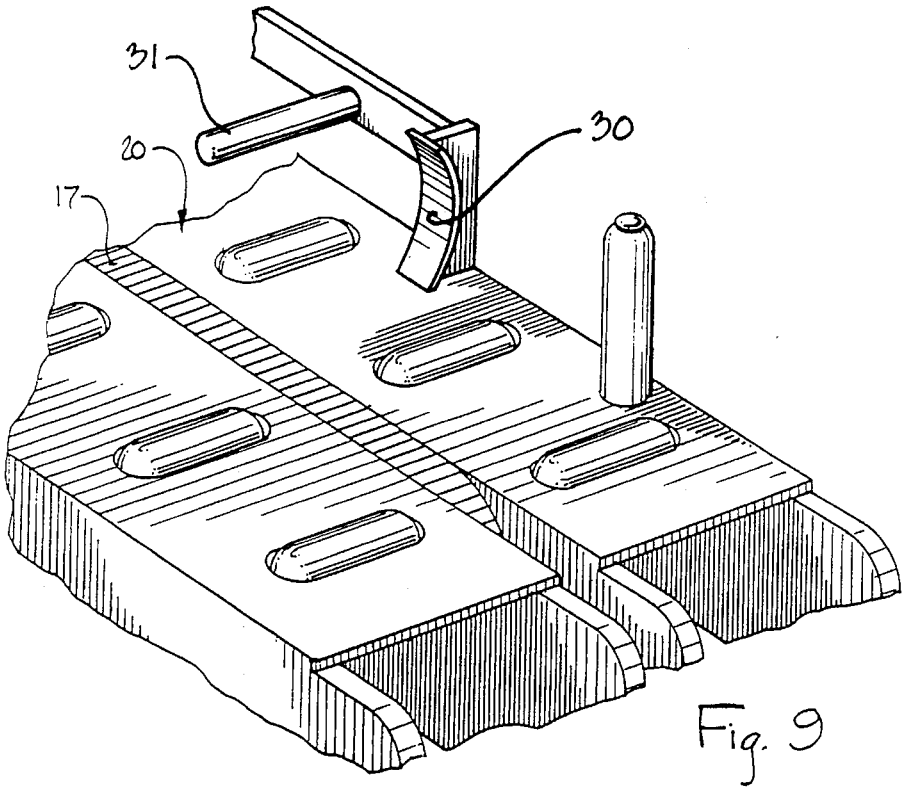
FIG. 9 is a perspective view showing the arcuate guide disposed in the sleeving station.

Attached to the second transport means 17 is at least one pusher means 18. Preferably, two spaced-apart pusher means 17 are attached but more than two pusher means 17 may be provided. The pusher means 18 has a tongue-like shape and is attached to the second transport means 17 so as to extend outwardly from the second transport means 17 so that, as the second transport means 17 is driven, the pusher means 18 protrudes above the surface of the transport station 13. The protruding pusher means 18 may thereby engage the approximate mid-point of the end of the tray 12 which is nearest to the first end 14 of transport station 13 and advance the tray 12 to the second end 15 of the transport station (FIG. 7). Preferably, the pusher means 18 extends at an angle from the second transport means 17 to cooperate with the angle on the end of the tray 12. The pusher means 18 assists in advancing the tray 12 in approximately a straight line through the transport station 13.

Each side of the transport station 13 has a guide 19 mounted thereon. The guides 19, preferably are mounted angularly from the first end 14 toward the second end 15 of the transport station 13 to direct and approximately center the tray 12 as the tray 12 is advanced through the transport station 13.

A sleeving station 20 is adjacent to, and communicating with, the second end 15 of the transport station 13. The second transport means 17 extends through the sleeving station 20 and is disposed in the approximate center of the sleeving station 20. In this manner, the second transport means 17, with the pusher means 18 attached thereto, advances the tray 12 and the sleeve 21 commonly used by the postal service, as will be described. The sleeving station 20 has a base surface 22, a first side 23 and an opposite second side 24.

A hopper 25 is disposed adjoining and substantially perpendicular to, the sleeving station 20. The hopper 25 is adjacent to the first side 23 of the sleeving station 20. The hopper 25 contains a plurality of collapsed sleeves 21. Each sleeve 20 is fiberboard having a top (24½ inches long, 11½ inches wide), a bottom (22 inches long, 11½ inches wide) and two sides therebetween (each side being 5 inches in height). Each side is trapezoidal in shape, the ends being angled outwardly from the bottom toward the top. An overhanging lip is formed on the top of the sleeve at each end thereof. The collapsed sleeve 21 may be opened by applying pressure against the folded edges and/or by raising the top of the sleeve and, when opened, forms a box-like shape having two open ends. The opened sleeve 21 is dimensioned to receive therein, the tray 12 through the open end. The collapsed sleeves 21 are stacked and rest on the bottom 26 of the hopper 25. At least one and preferably two, hopper belts 27 are mounted in the bottom 26 of the hopper at an angle of approximately 90° with respect to the second belt means 17 which extends through the sleeving station 20 adjoining the hopper 25. The hopper belts 27 are continuous belts and are power driven, being activated as desired and as will be described. The use of two hopper belts 27 provide more control and increase the use life of the belt 27. When the hopper belts 27 are driven, the collapsed sleeve 21 on the bottom of the stack, which is directly adjacent to the bottom 26 of the hopper 25, is transported from the hopper 25 into the sleeving station 20. A sleeve pusher bar 28 is connected to the hopper belts 27 and engages the folded edge of the collapsed sleeve 21. As the hopper belts 27 move toward the sleeving station 20, the sleeve pusher bar 28 advances the bottom most sleeve 21 into the sleeving station 20. Preferably, two spaced-apart sleeve pusher bars 28 are connected to the hopper belts 27.

Figure 12:
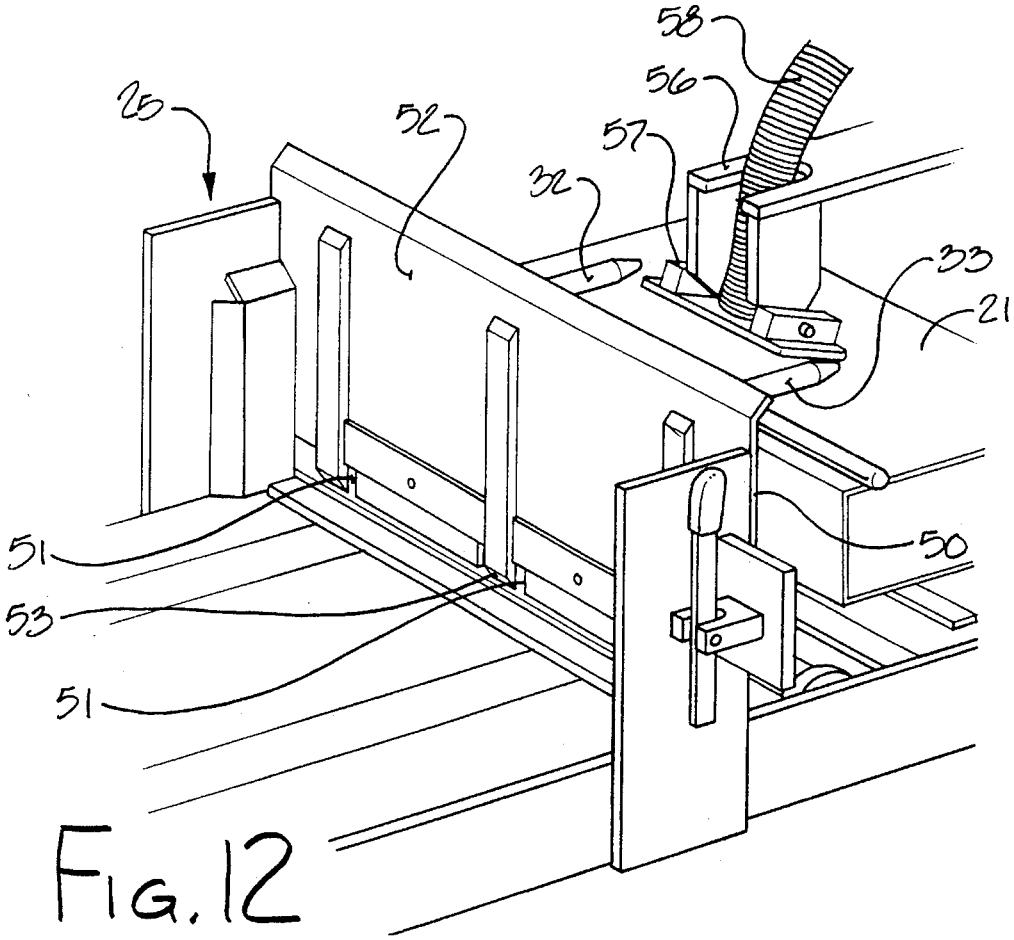
FIG. 12 is a perspective view of the feed plate disposed on the inside wall of the hopper.

The collapsed sleeves 21 frequently are frayed and uneven such that the sleeve 21 is dispersed into the sleeving station 20 only with difficulty. Also, only one collapsed sleeve 21 is to be dispensed at a time into the sleeving station 20. In order to better control the dispensing of only one collapsed sleeve 20, even if the sleeve is frayed, the inside wall 50 of the hopper 25, adjacent to the sleeving station 20 has two or more spaced-apart grooves 51 formed therein. A feed plate 52 is slidingly mounted in the grooves 51 (FIG. 12). Alternately, vertical tracks may be substituted for the grooves 51. The feed plate 52 effectively floats on the inside wall 50 of the hopper 25 with the collapsed sleeves 21 stacked along side of the feed plate 52. The feed plate 52 has a lower edge 53 which is angled from the hopper 25 toward the sleeving station 20. The lowermost collapsed sleeve 21 is directed against the angled lower edge 53 and is guided into the sleeving station 25. The angled lower edge 53 has a height which is approximately equal to the thickness of one collapsed sleeve 21 to prevent more than one sleeve 21 from being introduced into the sleeving station 20 at any one time. If desired, the portion of the frame 11 which supports the hopper 25 may be separated from the portion of the frame 11 which supports the transport station 13 and the sleeving station 20. Wheel means may be connected to the bottom of the frame 11 supporting the hopper 25 to provide a rapid and easy replacement of an empty hopper 25 with a hopper 25 filled with collapsed sleeves 21.

Figure 6:
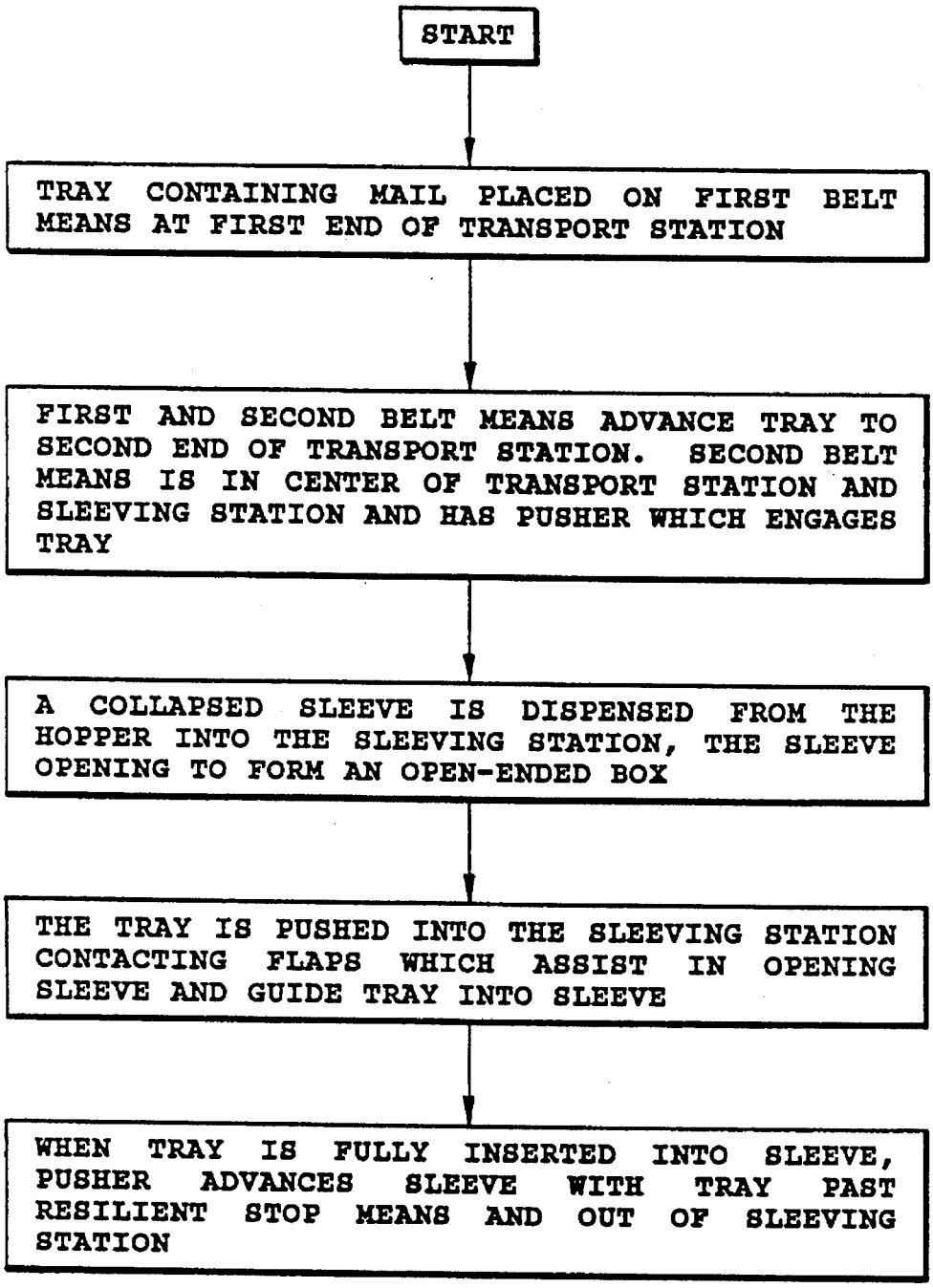
FIG. 6 is a flowchart showing the operation of the sleeving machine of the present invention.

In one embodiment, when the collapsed sleeve 21 enters the sleeving station 20, the folded edge of the collapsed sleeve 21 distal from the sleeve pusher bar 28, and the hopper 25, contacts at least one, and preferably two, concave arcuate guides 30 (FIG. 6). The arcuate guides 30 are mounted on the base of the sleeving station 20 distal from the hopper 25, the lower edge of the arcuate guide 30 being at a distance from the hopper 25 slightly greater than the width of the bottom of the sleeve 21. The collapsed sleeve 21 has a width greater than the width of the bottom of the sleeve 21 and the folded edge distal from the hopper 25 is pushed onto the concave portion of the arcuate guide 30. As the distal folded edge of the sleeve 21 advances upwardly on the arcuate guide 30, the collapsed sleeve 21 is thereby caused to open. The collapsed sleeve 21 is completely opened by contact of the top of the sleeve with a member 31 connected to the second side 24 of the sleeving station 20, distal from the hopper 25 and adjacent to the top edge of the arcuate guide. The member 31 extends toward the hopper 25 and is substantially perpendicular to the hopper 25 and parallel to the surface 22 of the sleeving station 20. The member 31 is at a height approximately equal to the height of the side of the sleeve 21. The member 31 is in contact with the top of the sleeve 21 and assists in retaining the sleeve 21 in the sleeving station 20. Preferably a pair of hold down guide arms 32 are mounted perpendicularly on the first side 23 of the sleeving station, each arm 32 extending outwardly over the sleeving station 20 on a horizontal plane approximately the same as the plane of the member 31. The arms 32 further provide guidance for the unfolding of the sleeve 21.

Figure 13:
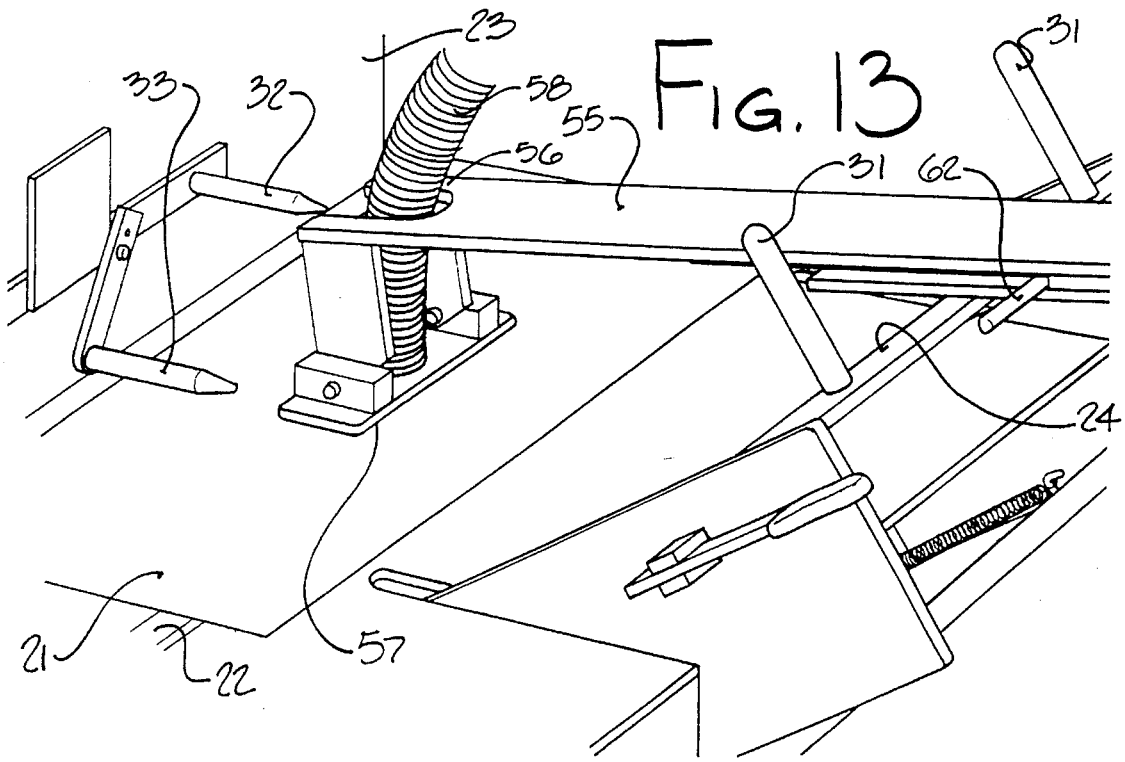
FIG. 13 is a perspective view of the second side of the sleeving station pivoted outwardly and the articulated arm with the suction head disposed near the collapsed sleeve.
Figure 14:
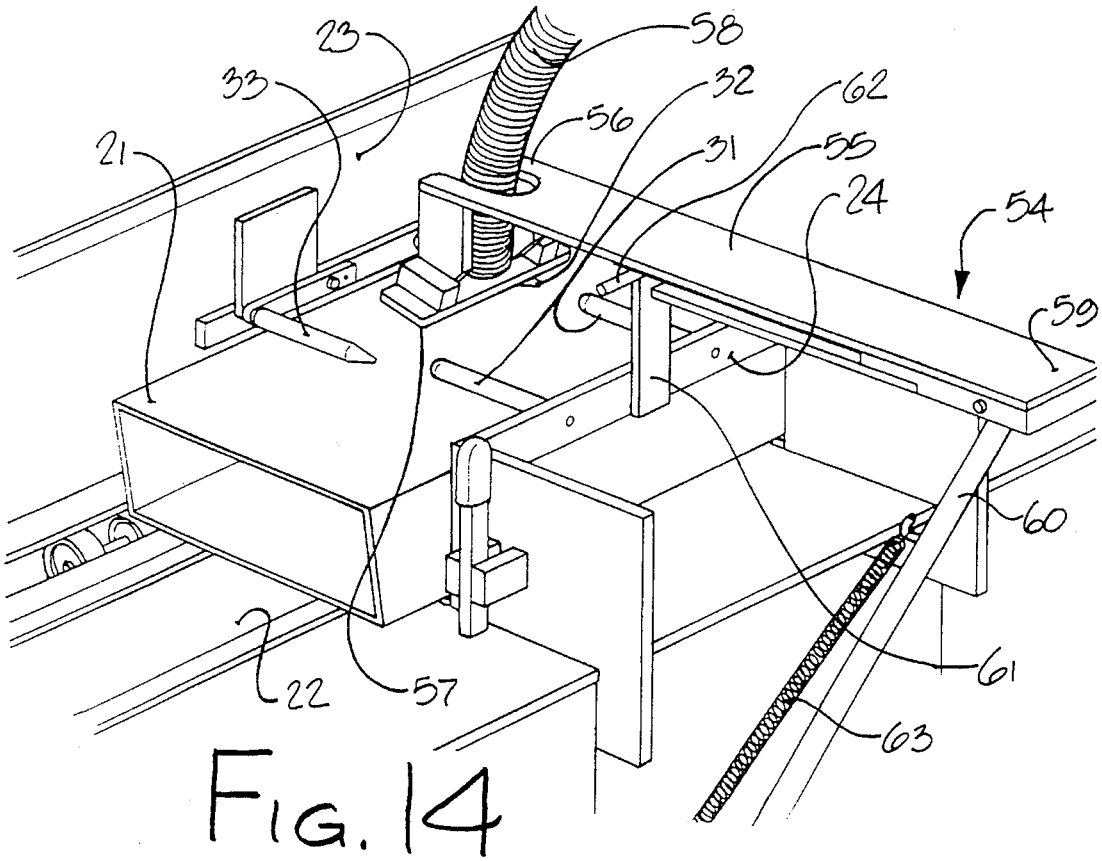
FIG. 14 is a perspective view of the opened sleeve in the sleeving station showing the second side in an upright position and the articulated arm above the opened sleeve.

In an alternate embodiment, the second side 24 of the sleeving station 21 is pivotally connected to the base surfaces 22 of the sleeving station 21 preferably by a hinge-type means. At least one and, preferably two, members 31 are connected to the second side 24 as described above for the first embodiment. As shown in FIGS. 13–14 an articulated arm 54 is pivotally mounted outside the second side 24 of the sleeving station 20 or, alternately, mounted on the second side 24. In either mounting, the articulated arm 54 moves first, towards and then, away from, the first side 23 of the sleeving station 20 when the second side 24 of the sleeving station 20 is pivoted as will be described. A swing arm 55 has a first end 56 which is disposed over the sleeving station 20. A suction head 57 is mounted on the first end 56 or along the length of the swing arm 55, preferably with a swivel or adjustable mounting to permit the suction head 57 to adapt to the top of the sleeve 21 as will be described. The suction head 57 is further connected to a source of vacuum (not shown) by a hose 58 or other means. In a preferred embodiment, the swing arm 55 has an opposite second end 59 which is pivotally connected to a connecting arm 60. The connecting arm 60 is further pivotally connected to the frame 11 outside of the sleeving station 20 and near the base surface 22 of the sleeving station. A pivot arm 61 is connected near the top, to the outside of the second side 24 of the sleeving station 20 and extends upwardly to a roller 62 which contacts the underside of the swing arm 55. A spring 63 is attached between the connecting arm 60 and the outside of the second side 24 of the sleeving station 20. When there is no sleeve 21 in the sleeving station 20, the second side 24 of the sleeving station 20 is pivoted outwardly from the base surface 22 and the articulated arm 55 is angled downwardly with the suction head 57 disposed near the base surface 22 within the sleeving station 20. As the collapsed sleeve 21 is dispensed from the hopper 25, vacuum is applied to the suction head 57 and the suction head 57 engages the top of the collapsed sleeve 21. Simultaneously, the second side 24 of the sleeving station 20 is pivoted toward an upright position. In so pivoting, the second side 24, the connecting arm 60, pivot arm 16 and spring 63 are moved to raise the first end 56 of the swing arm 55 from near the base surface 22 diagonally upwardly toward the first side 23. The suction head 57 swivels to move with the first end 56 of the swing arm 55 and to maintain the application of suction to the top of the collapsed sleeve 21 so as to expand the collapsed sleeve 21. The second side 24 may be pivoted by any means connected to the frame 11 so long as the second side 24 is pivoted between a position outwardly from the base surface 22 and an upright position and the pivotal movement is coordinated with dispensing of the sleeve 21 and movement of the suction head 57 as described herein.

Figure 15:
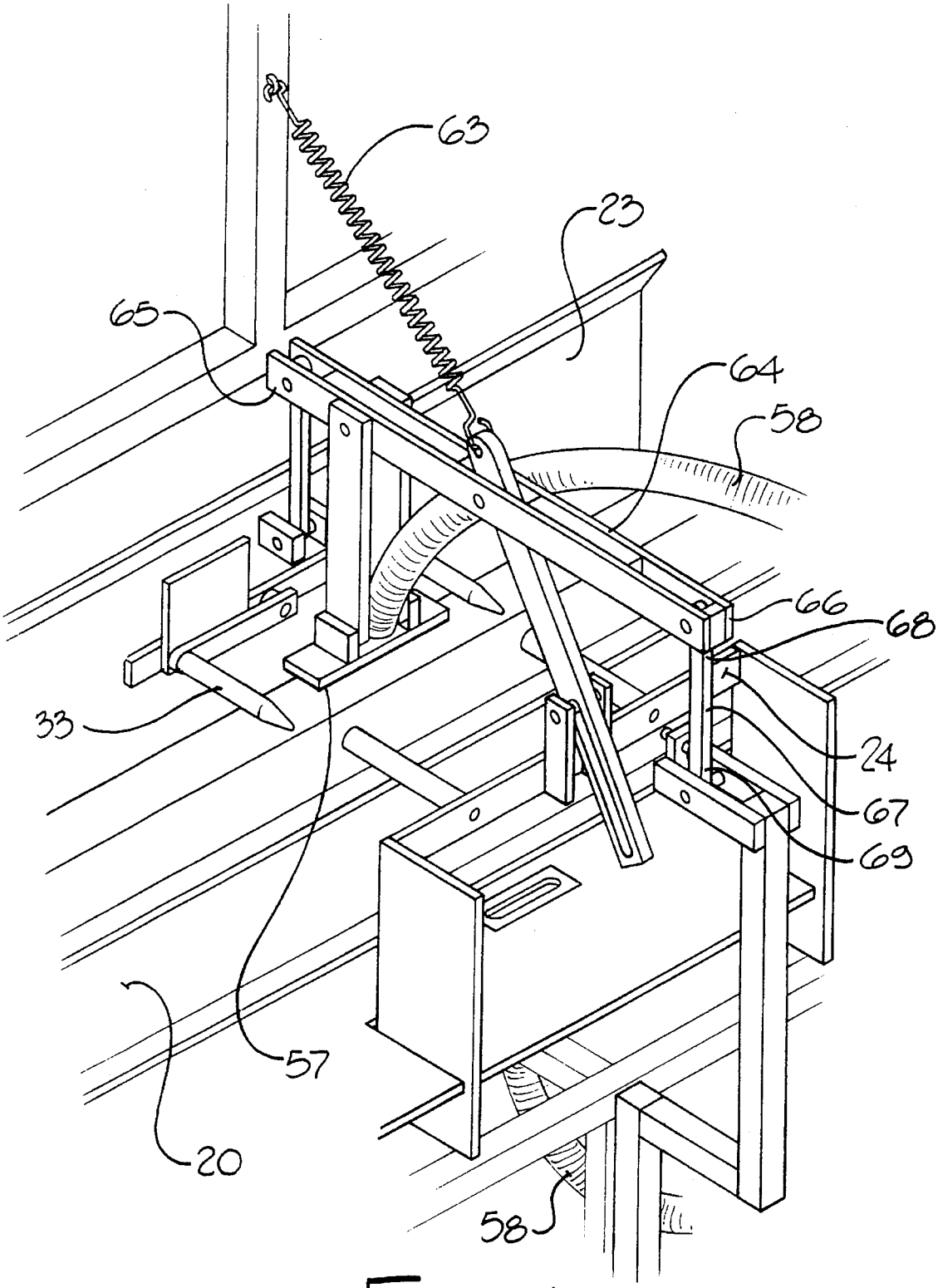
FIG. 15 is a perspective view of an alternate embodiment of an arm to which the suction head is attached.

In an alternate embodiment (FIG. 15), a beam 64 has one end 65 pivotably mounted on the first side 23 of the sleeving station 20 and an opposite second end 66 pivotally connected to a first end 68 of a supporting arm 67. The opposite, second end 69 of the supporting arm 67 is pivotally connected to sleeving station 20 or to the frame 11. The suction head 57 is attached to the beam 64. When the collapsed sleeve 21 is dispensed from the hopper 25 into the sleeving station 20, the supporting arm 67 is pivoted so as to lower the second end 66 of the beam 64 and to pivot the beam 64 downwardly. In this manner, the suction head 57 is placed in contact with the top of the sleeve 21 and vacuum is applied through the suction head 57. The supporting arm 67 is pivoted to raise the second end 66 of the beam 64 and to also raise the suction head 57. This, in turn, raises the top of the sleeve 21 to open the sleeve 21. The application of vacuum is discontinued and the beam 64 is raised above the top of the sleeve 21 to avoid interfering with movement of the sleeve 21. The sequence is repeated with each dispensing of a collapsed sleeve 21 into the sleeving station 21.

Figure 16:
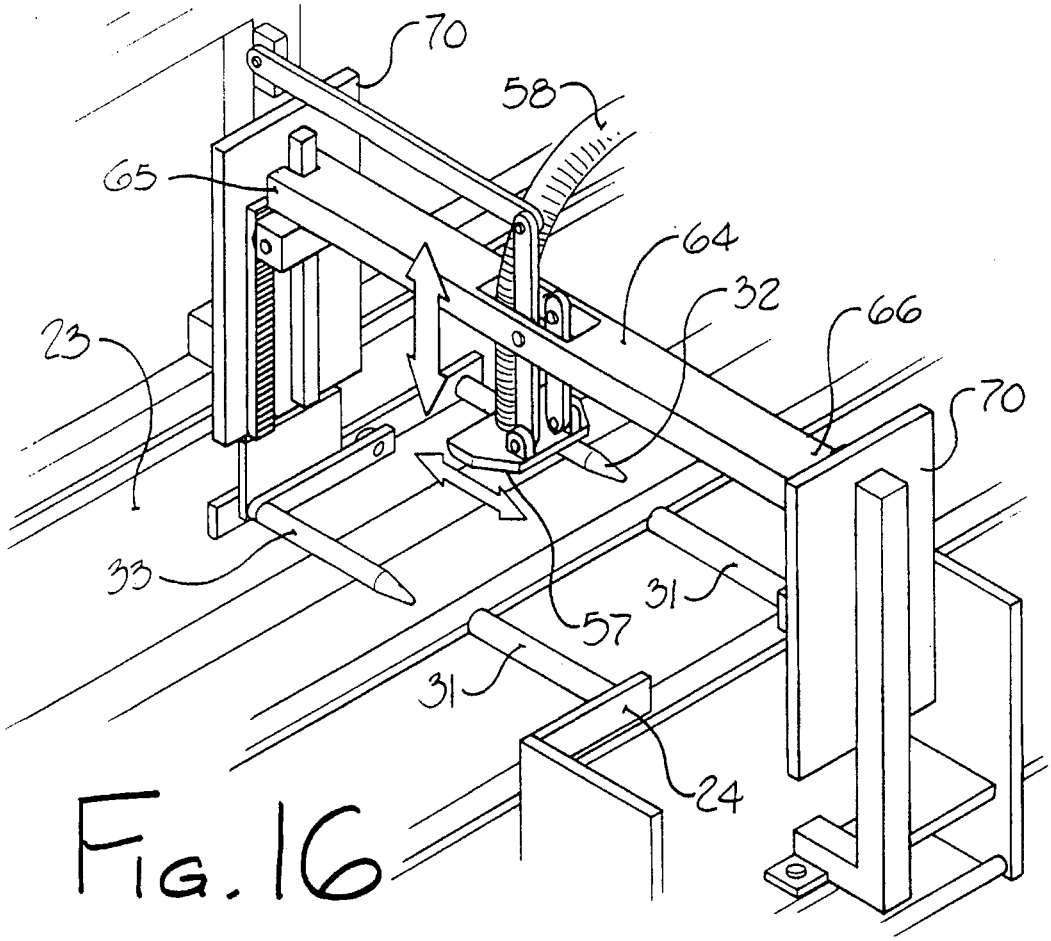
FIG. 16 is a perspective view of another embodiment showing attachment of the suction head to a movable beam.

In another embodiment (FIG. 16) the beam 64 with the attached suction head 57, is slidably mounted between a pair of vertical posts 70. Preferably, one of the vertical posts is connected to the first side 23 of the sleeving station 20 and the other vertical post is connected to the second side 24 of the sleeving station 24. Alternately, the posts 70 could be at the entrance and exit of the sleeving station 20. The ends 65, 66 of the beam 64 are slidably connected to the respective opposite vertical posts 70 and means (electric, hydraulic, pneumatic) are provided to raise and lower the beam 64. As previously described, the vacuum is applied to open the collapsed sleeve 21 and the vertical movement of the beam 64 is coordinated with the dispensing of the collapsed sleeve 21.

Figure 20:
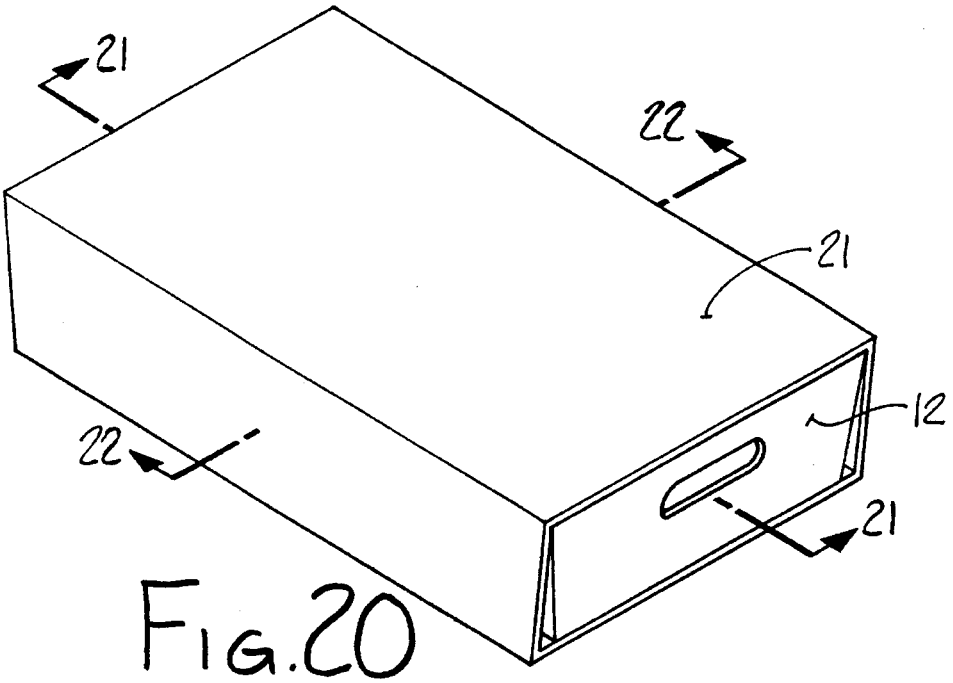
FIG. 20 is a perspective view of the tray received within the sleeve.
Figure 21:
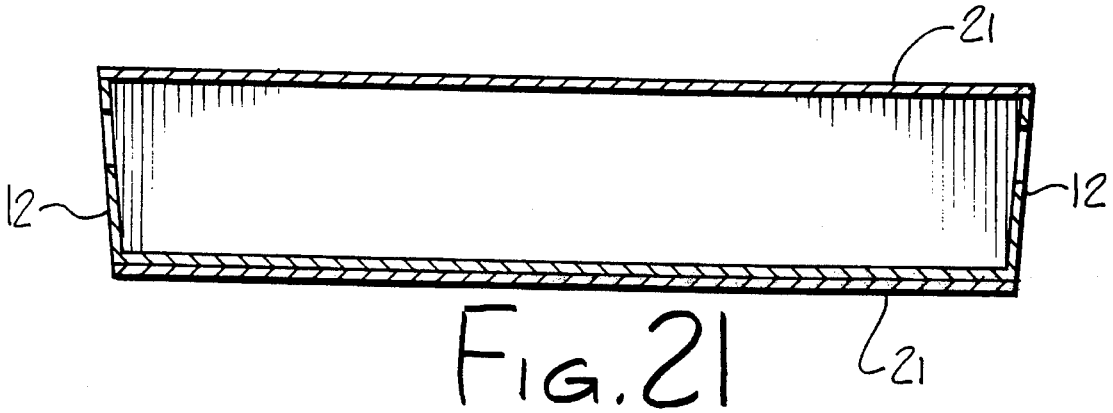
FIG. 21 is a cross-sectional view taken across the lines 21—21 of FIG. 20.
Figure 22:
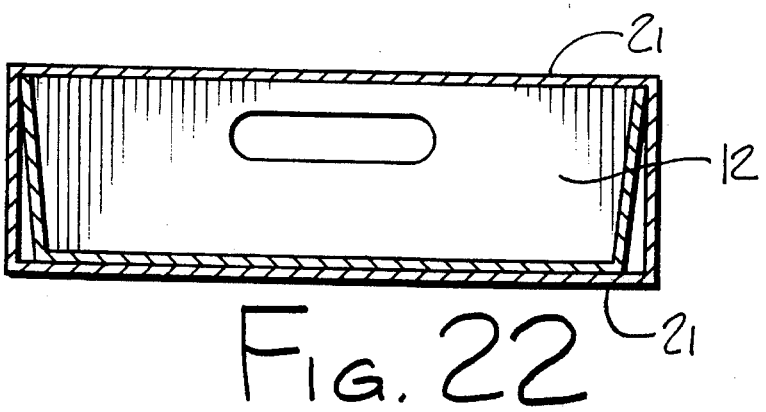
FIG. 22 is a cross-sectional view taken across the lines 22—22 of FIG. 20.

The pivoting movement of the second side 24 assists in the expansion of the collapsed sleeve 21 by applying pressure against the side of the sleeve 21 and squeezing the sleeve 21 between the sides 23, 24 of the sleeving station 20. The top of the collapsed sleeve 21 is raised without lifting the entire sleeve 21. If desired, vacuum may also be applied to the bottom of the sleeve 21 to retain the sleeve 21 when the vacuum is applied concurrently to the top of the sleeve 21. When the sleeve 21 has fully opened, the top of the sleeve 21 contacts the members 31 on the second side 24 and hold down guides 32 on the first side 23 of the sleeving station. At this point, the vacuum is discontinued and the tray 12 is received inside the opened sleeve 21 (FIGS. 20–22). The sleeve 21 with the tray 12 inside is transported out of the sleeving station 20 and the sleeving station 20 no longer has a sleeve 21 disposed therein. Accordingly, the second side 24 of the sleeving station 20 is pivoted outwardly from the base surface 22 and the articulated arm 54 is disposed with the suction head 57 within the sleeving station 20 near the base surface 22 thereof.

A sensing means 33 is pivotally mounted on the hopper 25 extending over the sleeving station 20 in a manner similar to the arms 32 and in approximately the same horizontal plane as the arms 32. The sensing means 33 preferably is lowered by gravity and raised by opening of the sleeve 21. The sensing means 33 preferably is in the shape of a rod having an end distal from the first side 23 of the sleeving station 20. The end of the rod is tapered to become more conical to permit initial contact with the top of the collapsed sleeve 21 and to guide the sensor 33 during expansion of the sleeve 21. The sensing means 33 provides information that an unfolded sleeve 21 is disposed in the sleeving station 20 and this information is used in the control of the sleeving machine 10 as will be described.

Disposed between the second end 15 of the transport station 13 and the sleeving station 20 are flaps, a first pair of flaps 35, a second pair of flaps 36 and a third flap 38. Preferably the first pair of flaps 35, and the flap 38 are mounted on respective rods extending across the sleeving machine 10 such that the flaps 35, 38 are substantially perpendicular to the second transport means 17. The first pair of flaps 35 is mounted side-by-side straddling the second transport means 17 and extending upwardly above the plane of the surface of the sleeving station 20. The second pair of flaps 36 are mounted on the opposite sides of the belts 16A, 16B and extend inwardly toward the second transport means 17. The third flap 38 is mounted above the first pair of flaps 35 and extends downwardly so that the first pair of flaps 35 is immediately adjacent to the third flap 38. If desired, the third flap 38 may be a pair of spaced-apart flaps. The third flap 38 is mounted above the surface of the sleeving station 20 at a height greater than the height of the tray 12 so that the tray 12 may pass under the mount. All of the flaps 35, 36, 38 are mounted in a hinged manner wherein the flaps may hingedly move so that the unmounted ends of the flaps are deflected in a direction toward the sleeving station 20. Preferably, the hinges are spring actuated so that the flaps 35, 36, 38 may return to the respective initial positions after being moved. However, gears or other means of permitting return of the respective flaps may be used. When the tray 12 is advanced from the transport station 13 into the sleeving station 20 due to the pusher means 18, the tray 12 initially contacts the flaps 35, 36, 38. The flaps 35, 36, 38 are urged into the open sleeve 21 disposed in sleeving station 20. The first pair of flaps 35 contact the bottom of the opened sleeve 21 and hold the sleeve 21 against the surface of the sleeving station 20. The second pair of flaps 36 are urged into the open sleeve 21 disposed in the sleeving station 20 and contact the sides of the opened sleeve 21. The third flap 38 is urged into the open sleeve 21 and contacts the top of the sleeve 21. The flaps 35, 36, 38 in this manner, fully open the sleeve 21 to facilitate entry of the tray 12 into the opened sleeve 21.

Figure 10A:
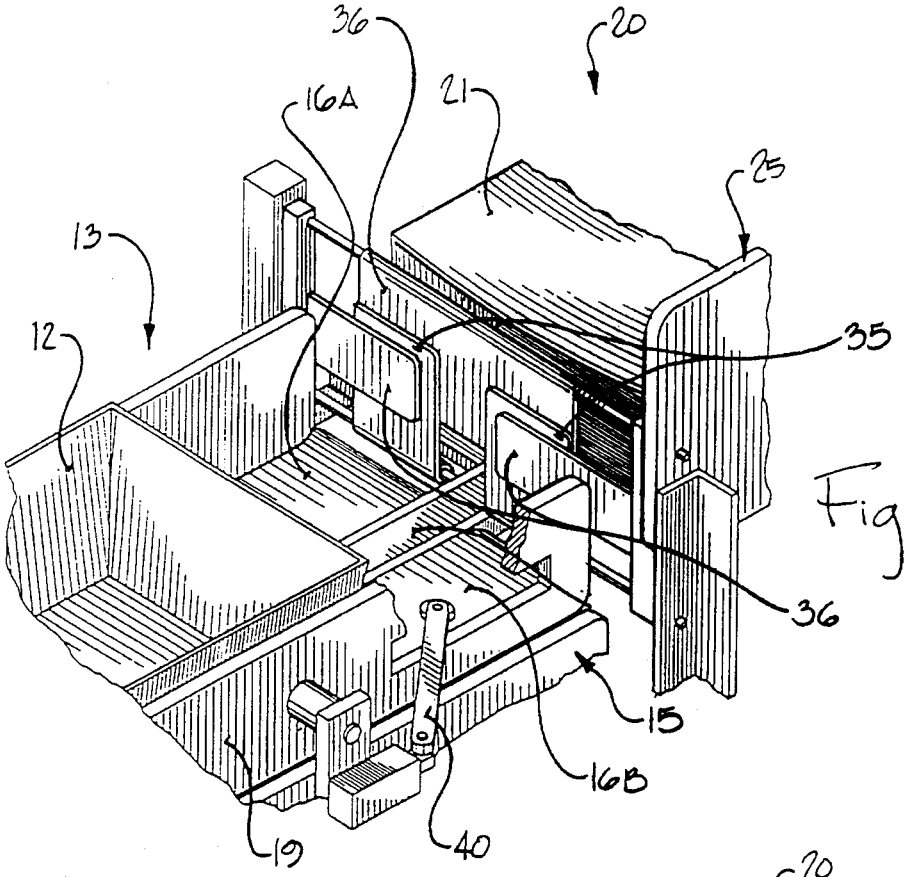
FIGS. 10A–10B are perspective views showing the opening and closing of the flaps which hold the sleeve in an open position.
Figure 10B:
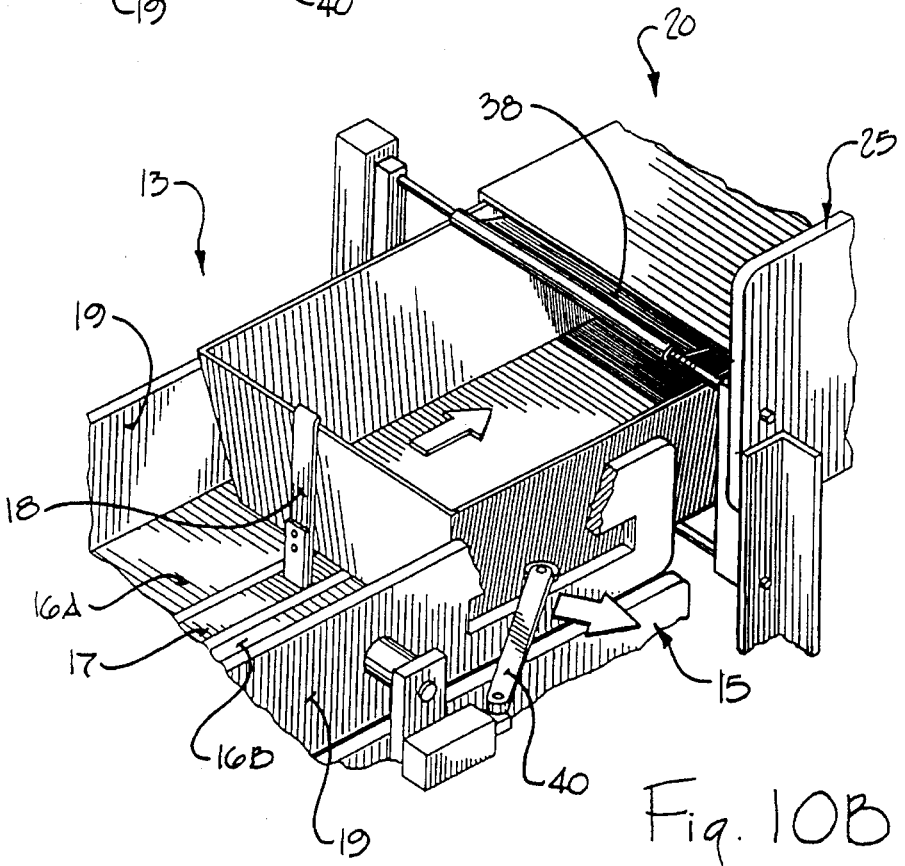
Figure 17:
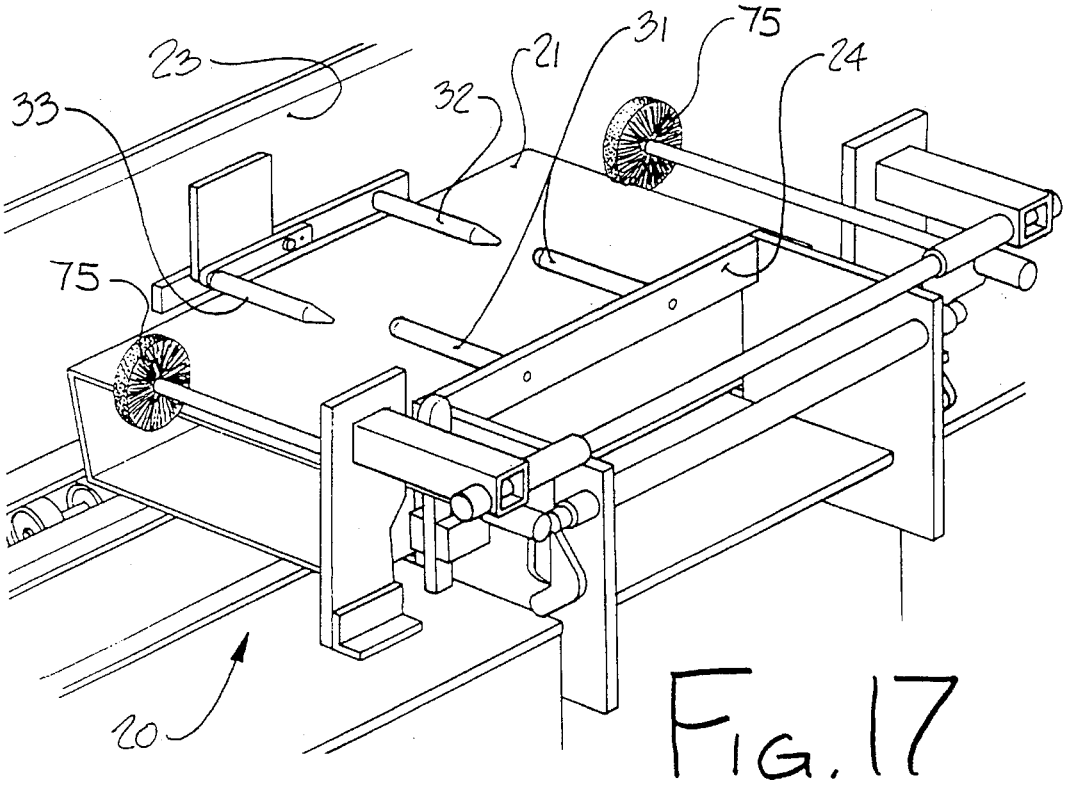
FIG. 17 is a perspective view of the sleeving station showing brushes assisting in opening the sleeve.

Alternately, a pair of rotating brushes 75 are mounted above the sleeving station 20. The bushes 75 are on arms extending between the first sidewall 23 and the second sidewall 24. One brush 75 is disposed near the entrance end of the sleeving station 20 and the other brush 75 is disposed near the exit end of the sleeving station 20. When the sleeve 21 is in the sleeving station 20, the brushes 75 rotate to engage the respective overhanging lips on the top of the sleeve 21 such that the brushes 75 lift the respective overhanging lips and assist in opening the sleeve and maintaining the sleeve in an open position to facilitate insertion of the tray 12 into the open sleeve 20 (FIG. 17). As the tray 12 is received in the sleeve 21, the pusher means 18 on the second transport means 17 pushes the sleeve 21 containing the tray 12 out of the sleeving station 20 and the flaps 35, 36, 38 are urged to return to the initial respective positions which are substantially perpendicular to the surface of the sleeving station 20 (FIGS. 10A–10B).

Figure 11:
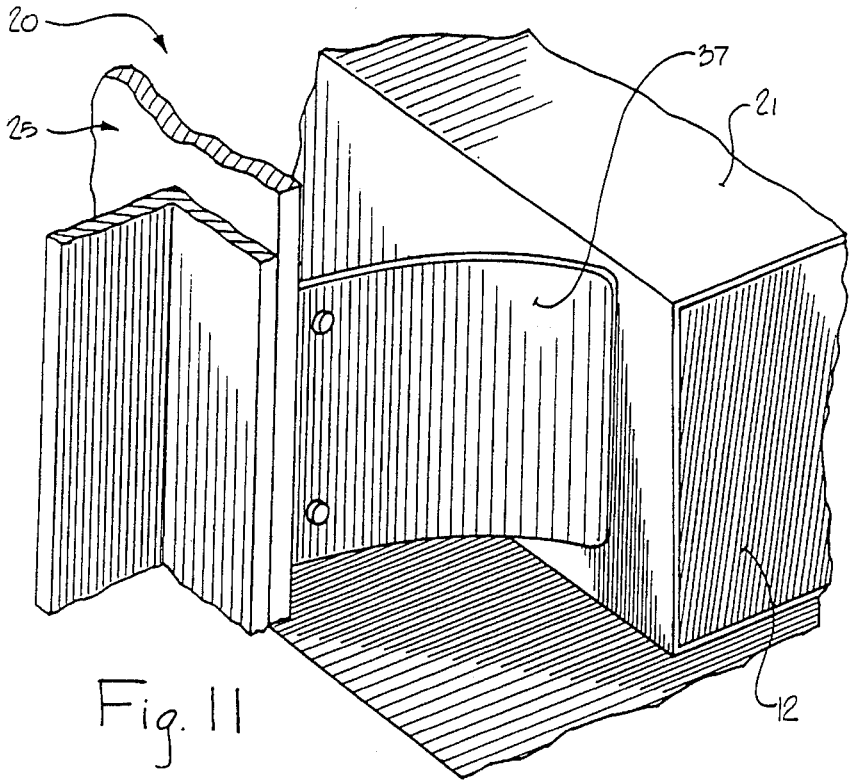
FIG. 11 is a perspective view showing the resilient stop means.

At the exit of the sleeving station 20, in one embodiment, there is mounted at least one resilient stop means 37 (FIG. 11). Preferably the resilient stop means 37 is a pair of upright paddles 37, one paddle disposed on either side of the exit of the sleeving station 21 such that the sides of the sleeve 21 and tray 12 contact the respective paddles 37. In a preferred embodiment, each paddle 37 is mounted using a resilient material, such as a plastic interface, so that the resiliency may be overcome and the paddle 37 may be pushed outwardly from the sleeving station 20 when the sleeve 21 containing the tray 12 exits from the sleeving machine 10. Other mounting means such as spring loaded hinges may be used. The resilient stop means 37 also serve to retain the opened sleeve 21 in the sleeving station 20 and further provide support for the opened sleeve 21 as the tray 12 is introduced into the opened sleeve 21 by restraining any longitudinal movement of the sleeve 21.

Figure 18:
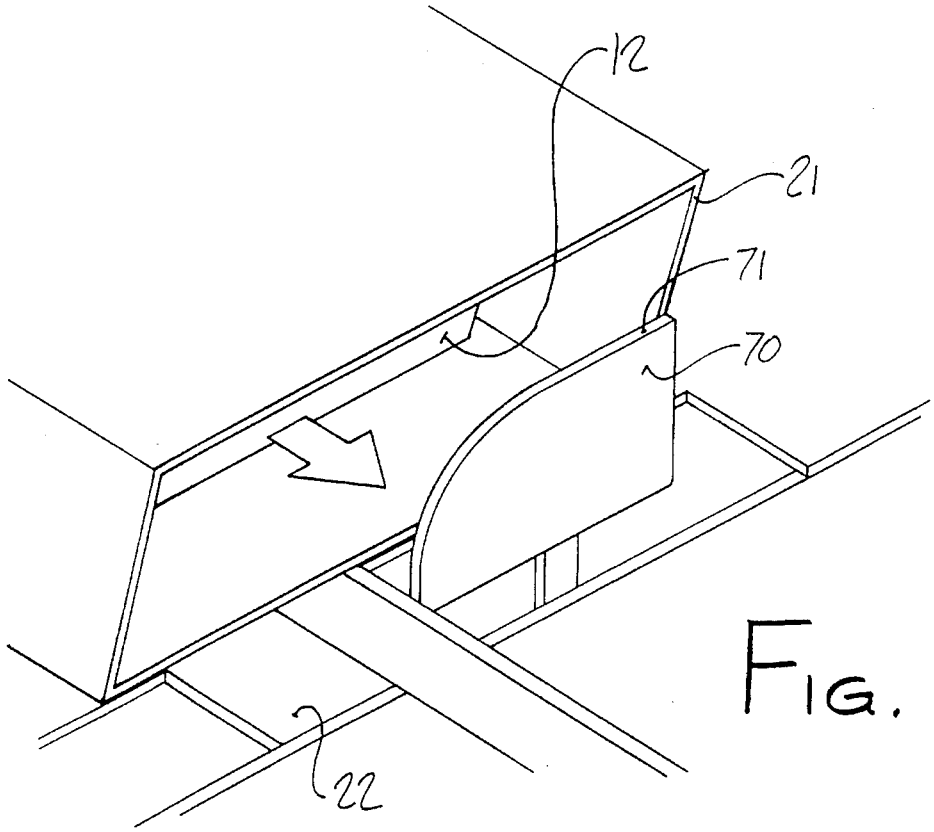
FIG. 18 is a perspective view of the stop plate in an upright position retaining the opened sleeve.
Figure 19:
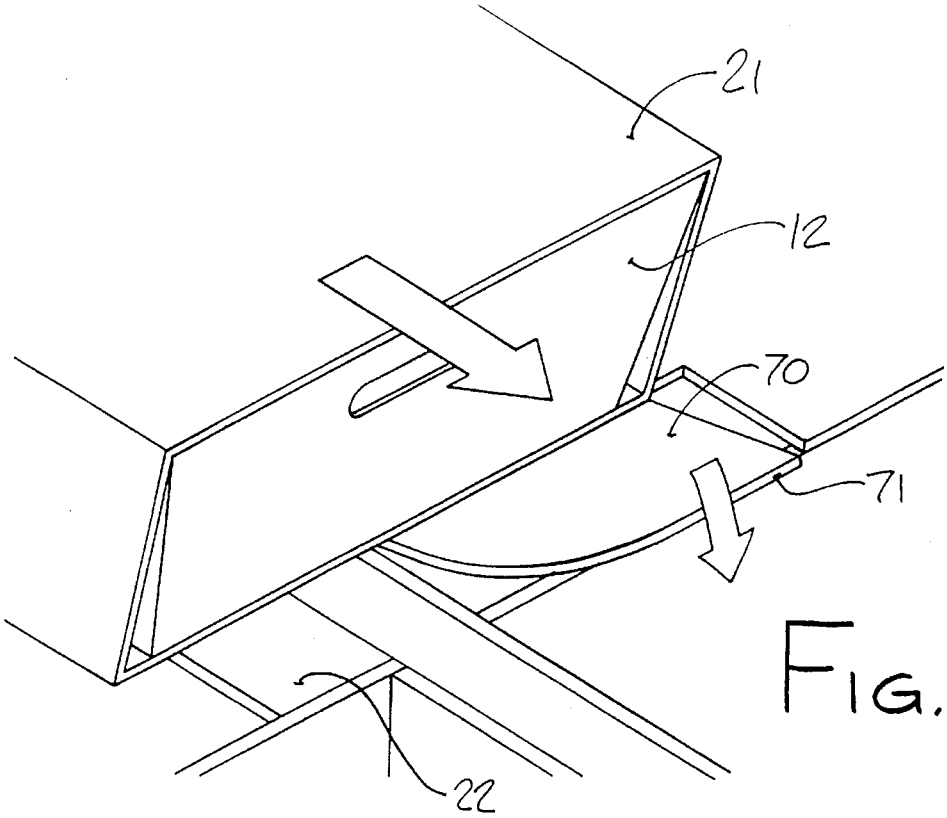
FIG. 19 is a perspective view of the stop plate pivoted downwardly permitting exiting of the sleeve with the tray inside.

In an alternate embodiment, as shown in FIGS. 18–19, a stop plate 80 is pivotally mounted in the base surface 22 of the sleeving station 20 near the exit end thereof. The stop plate 80 protrudes upwardly from the base surface 22 and contacts the bottom of the sleeve 21 when the sleeve 21 is disposed in the sleeving station 20. The stop plate 80 is provided with sufficient resistance to pivoting to retain the sleeve 21 in the sleeving station 20. Also, the stop plate 80 has an upper edge 81 which is inclined upwardly in a direction from the first side 23 towards the second side 24 of the sleeving station 20. This inclined edge 81 assists in opening the collapsed sleeve 21. As the collapsed sleeve 21 is introduced into the sleeving station, the top of the sleeve 21, which is slightly longer than the bottom, contacts the lower portion of the inclined edge 81 and slides upwardly on the inclined edge 81 to assist in opening of the collapsed sleeve. When the sleeve 21 is opened, the bottom of the sleeve 21 abuts the stop plate 80. When the tray 12 with the mail is inserted into the opened sleeve 21, additional force is exerted against the stop plate 80 which is sufficient to cause the stop plate 80 to pivot downwardly toward the exit end of the sleeving station 20 and to permit the sleeve 21, with the tray 12 inside, to exit from the sleeving station 20.

A control network is provided to obtain the required sequence of operations. When power is initially supplied to the sleeving machine 10, a sleeve 21 is dispensed from the hopper 25 and is opened in the sleeving station 20 as will be described. When the tray 12 is disposed in the transport station 13 on the first transport means 16, the tray 12 advances into the guides 19. A first sensor 40, mounted in the guide 19 near the second end 15 of the transport station 13, activates the second transport means 17 and pusher 18 to push the tray 12 past the flaps 35, 36, 38 into the sleeve 21 and through the sleeving station 20 past the resilient stop means 37. When the opened sleeve 21, with the tray 12 therein, is removed from the sleeving station 20, the sensing means 33, previously described, overrides third sensor 42, mounted under the hopper 25, activates the hopper belts 27 and the sleeve pusher bar attached .thereto, so that a sleeve 21 is dispensed from the hopper 25 into the sleeving station 20. The sensing means 33 also controls a switch (not shown) to control vacuum to the suction head 57. When the sensing means 33 is lowered, preferably by gravity, the switch is activated and vacuum is applied to the suction head 57. When the sensing means 33 is lowered, the switch is deactivated and vacuum is removed. When the dispensed sleeve 21 opens in the sleeving station 20, the third sensing means 42 deactivates the hopper belts 27. Concurrently, a second sensor 41, mounted under the sleeving station 20 is triggered by the pusher means 18 on the second transport means 17. The second sensor 41, deactivates the drive for the second transport means 17. Introduction of a new tray 12 in the transport station resumes the cycle, an opened sleeve 21 being available in the sleeving station 20.

A starting switch 45 to provide power to the sleeving machine 10 is mounted on the frame 11 near the transport station. The starting switch 45 has a time delay to assure the safety of the persons operating the machine. The switch 45 preferably has a button which must be held for approximately 5 seconds to start the machine. An audible sound (such as a buzzer) and a visual signal (a light) are produced when the button is held. Additional safety features of the machine are four emergency stop switches 46 and four associated visual indicators 47 disposed about the sleeving machine 10. Each emergency stop switch 46 completely removes power from the sleeving machine 46 and simultaneously, activates the visual indicator 47 which is located near the respective emergency stop switch 46. In this manner, the emergency stop switch 46 which was used is immediately identified. A series of safety cut-off switches are included in the machine to protect the equipment from accidental damage if non-standard sleeves or trays are introduced. Also, if the sleeving operation is interrupted or the hopper 25 is empty and no longer has sleeves 21, a system malfunction sensor detects the interruption and stops the sleeving machine 10. The entire sleeving machine 10, preferably is semi-enclosed to preclude injuries to persons operating the equipment. If desired a computerized control system and microprocessor may be utilized to control the machine and to coordinate the machine with a conveyor line at the inlet and outlet of the machine.

The method of automatically sleeving the tray 12 using the sleeving machine 10 is as follows:

The starting switch 45 is turned on and the first transport means 16 is activated. Also, sensing means 33 overrides third sensor 42, the hopper belts 27 are activated and a sleeve 21 is pushed into the sleeving station 20, where the sleeve 21 is opened. In the embodiment having vacuum and a suction head 57, sensing means 33 also controls the application and removal of vacuum to the top of the sleeve 21. The third sensor 42 deactivates the hopper belts 27. A tray 12 containing mail is placed on the first end 14 of the transport station 13 and the tray 12 advances to the second end 15 of the transport 13. The second transport means 17 is activated by the first sensor 40 and the pusher means 18 engages the tray 12 and advances the tray 12 against the flaps 35, 36, 38. The flaps 35, 36, 38 are hingedly moved to assist in holding the opened sleeve 12 and to guide the tray 12 into the sleeve 21. The tray 12 is pushed into the sleeve 21 by the pusher means 18 and the sleeve 21 with the tray 12 therein is pushed out of the sleeving station 20. The second sensor 41 is triggered by the pusher means 18 and the second transport means 17 is deactivated. When the opened sleeve 21 is removed from the sensing station 20, the sensing means 33 concurrently overrides the third sensor 42 and activates the hopper belts 27, so that a sleeve is dispensed and opened in the sleeving station 20. Another tray is received in the transport station 13 and the operation is repeated. The hopper 25 is refilled with collapsed sleeves 21 as needed.

The sleeving machine 10 can be automatically operated at a linear rate of 120 to 200 feet per minute. This rate of operation translates to approximately 600 to 1,800 trays 12 being sleeved in one hour. The postal service has established a linear rate of 130 ft./min. for automatic transport of mail. When operating at a conveyor speed of 130 feet per minute, approximately one and six-tenth (1.6) seconds are required from the entry of the tray 12 on the first end 14 of the transport station 13 to the entry of the tray 12 into the sleeving station 20. Approximately four-tenth (0.4) seconds are required to complete the sleeving operation. Thus, a sleeving cycle is completed in approximately 2 seconds with an 1,800 tray/hr. throughput.

The sleeving machine 10 is capable of operating with used trays 12 and used sleeves 21 so long as these units are undamaged. Many of the used trays 12 and sleeves 21 were unusable for manual operation.

Thus, the present invention provides automated equipment which is more efficient and more rapid than previously available equipment or procedures, and which is compatible with postal service operations. The present invention is safe for use.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A sleeving machine for automatically inserting a tray of postal mail into a sleeve, the sleeve having a top, a bottom, two opposite sides therebetween, and two opposite open ends, the sides each having a height, the machine comprising:

a transport station having a continuous transport means disposed longitudinally therein to move the tray;

a sleeving station having a base surface, a first sidewall, an opposite second sidewall, an entrance end and an opposite exit end, the entrance end of the sleeving station being adjacent to the transport station, the sleeving station communicating with the transport station, the transport means extending longitudinally through the sleeving station for advancing the tray in a direction from the entrance end to the exit end;

said first sidewall being a hopper, the hopper containing therein a plurality of collapsed sleeves, means within the hopper for dispensing the collapsed sleeves, one at a time as desired, into the sleeving station;

a source of vacuum, a suction head interruptably connected to the source of vacuum, the suction head being adjustably disposed above the sleeving station for engaging the top of the collapsed sleeve and for assisting in opening the sleeve, such that when the sleeve is dispensed from the hopper, the sleeve is received between the opposite walls of the sleeving station, the base surface of the sleeving station supporting the bottom of the sleeve, the hopper abutting and supporting one of the sides of the sleeve, wherein the open ends of the sleeve are oriented in the direction of movement of the tray such that the tray may be advanced and disposed inside the opened sleeve.

2. The sleeving machine of claim 1, further comprising the second sidewall of the sleeving station distal from the hopper being pivotally connected to the base surface of the sleeving station and extending upwardly therefrom, means for pivoting the second side of the sleeving station being attached to the sleeving station, the second sidewall being pivoted outwardly from the base surface in the absence of the sleeve in the sleeving station and being pivoted inwardly toward the hopper to an upright position simultaneously with the dispensing of the collapsed sleeve from the hopper into the sleeving station, wherein the second sidewall of the sleeving station contacts the other side of the sleeve and assists in opening the sleeve.

3. The sleeving machine of claim 2, further comprising at least one retaining member for retaining the top of the opened sleeve being connected to the second sidewall of the sleeving station, said at least one retaining member extending from the second sidewall of the sleeving station towards the first sidewall of the sleeving station, said at least one retaining member being connected at a height above the base surface approximately equal to the height of the sides of the sleeve, wherein the at least one retaining member contacts the top of the opened sleeve.

4. The sleeving machine of claim 1 further comprising an arm mounted above the sleeving station, the suction head being mounted on the arm, the arm being vertically movable permitting the suction head, with vacuum applied, to engage the top of the collapsed sleeve in the sleeving station and the arm to be raised to expand the collapsed sleeve to an opened position.

5. The sleeving machine of claim 1, further comprising a sensor pivotably mounted on the first side of the sleeving station and extending inwardly into the sleeving station away from the hopper, the sensor being lowered, the top of the collapsed sleeve in the sleeving station being contacted by the pivotably depending sensor, said sensor being pivotably raised as the collapsed sleeve is opened.

6. The sleeving machine of claim 5, wherein the sensor is a rod having an end distal from the first side of the sleeving station, said end being tapered to permit initial contact with the top of the collapsed sleeve and to guide the sleeve during expansion of the sleeve.

7. The sleeving machine of claim 5, further comprising the sensor being connected to a switch, the switch controlling the application of vacuum to the suction head, wherein the sensor being lowered, the switch being activated and vacuum being applied upon contact between the suction head and the top of the collapsed sleeve and wherein, the sensor being raised upon opening of the sleeve, the switch being inactivated and vacuum being removed.

8. The sleeving machine of claim 1, further comprising the hopper having an inside wall adjacent to the first side of the sleeving station, a floating feed plate slidably attached vertically to the inside wall, the feed plate having a lower edge, at least a portion of the lower edge being angled toward the sleeving station, wherein only a lowermost collapsed sleeve within the hopper is directed into the sleeving station.

9. The sleeving station of claim 1, further comprising, a stop plate being pivotally mounted in the base surface near the exit end of the sleeving station, the stop plate protruding upwardly above the base surface of the sleeving station, contacting the bottom of the sleeve and preventing movement of the sleeve as the tray is disposed inside the opened sleeve, the stop plate being pivotally moved substantially flat with the base surface of the sleeving station when contacted by the tray of postal mail, wherein the tray of postal mail disposed inside the sleeve is permitted to exit from the sleeving station.

10. The sleeving machine of claim 1, further comprising a first and a second rotatable brush, the first rotatable brush being mounted above the entrance end of the sleeving station, the second rotatable brush being mounted above the exit end of the sleeving station, both brushes extending between the first and second sidewalls of the sleeving station, the brushes rotatably engaging a respective overhanging lip on the top of the sleeve at the open ends thereof, thereby lifting the respective overhanging lip and assisting in opening the collapsed sleeve and maintaining the sleeve in an open position.

11. The sleeving machine of claim 1, further comprising at least one pusher attached to the transport means and extending outwardly from the transport means to engage the tray and to push the tray through the transport station and through the sleeving station.

12. A sleeving machine for automatically inserting a tray of mail into a sleeve, the sleeve having a top, an opposite bottom, two opposite sides therebetween, two opposite open ends, the sides each having a height, and the machine comprising:

a frame having a first side, a second side, an entrance end and an opposite exit end, a transport means disposed longitudinally in the frame between the sides thereof, wherein the tray may be moved longitudinally from the entrance end to the opposite exit end, a hopper disposed on the first side of the frame near the exit end adjacent to the transport means, the hopper forming one sidewall of a sleeving station, a plurality of collapsed sleeves being contained in the hopper, means within the hopper for laterally dispensing the collapsed sleeves, one at a time, as desired, onto the transport means, and a panel disposed on the second side of the frame opposite from the hopper, the panel forming a second sidewall of the sleeving station, receiving means disposed on the panel for bracing the sleeve against the sidewall of the hopper to assist in opening the collapsed sleeve for receiving the tray within the opened sleeve.

13. The sleeving machine of claim 12, wherein the panel has an upper edge and an opposite lower edge, the lower edge being pivotally connected to the second side of the frame, means for pivoting the second side of the sleeving station being attached to the frame, the panel being pivoted outwardly from the frame in the absence of the collapsed sleeve on the transport means, the panel being pivoted to an upright position as the collapsed sleeve is dispensed from the hopper onto the transport means, the pivoted panel contacting the one side of the sleeve and assisting in opening the sleeve from the collapsed disposition to an opened disposition by pressing the opposite side of the sleeve against the hopper.

14. The sleeving machine of claim 12, further comprising at least one member for retaining the top of the opened sleeve being connected to the panel on the second side of the frame, the at least one retaining member extending from the panel towards the hopper, the at least one retaining member being a height above the frame approximately equal to the height of the side of the sleeve, wherein the at least one retaining member contacts the top of the opened sleeve.

15. The sleeving machine of claim 12, further comprising a source of vacuum, a suction head interruptably connected to the source of vacuum, the suction head being adjustably disposed above the transport means and adjacent to the hopper for engaging the top of the sleeve and for opening the sleeve.

16. A machine for inserting trays of mail into respective sleeves, wherein each tray has an open top and further has tapered sides and tapered ends, respectively, and wherein each sleeve is substantially rectangular and has opposite sides, a top, a bottom and open ends, the machine comprising conveyorized means for moving the trays of mail, one at a time, in a given direction completely through the machine, from an entrance to an opposite exit, a hopper containing a stack of the sleeves, each of the sleeves in the hopper being folded substantially flat, means within the hopper for feeding the sleeves out of the hopper, one at a time, into a sleeving station, the sleeving station having a base and a pair of opposite substantially parallel sidewalls, the hopper being one of the sidewalls, the flat sleeves being disposed in a direction substantially transverse to the direction in which the trays are moved by the conveyorized means, such that each sleeve is positioned immediately ahead of a respective tray and in synchronism therewith, means for opening each sleeve within the sleeving station, and means for inserting each tray into a respective sleeve, within said sleeving station such that when the sleeve is dispensed from the hopper, the sleeve is received between the opposite sidewalls of the sleeving station, the base surface of the sleeving station supporting the bottom of the sleeve, the hopper abutting and supporting one of the sides of the sleeve, such that the trays of mail are substantially covered, and such that the mail in the trays does not fall out of the trays.

17. The machine of claim 16, wherein the means for opening each sleeve are arcuate guides disposed on the sidewall of the sleeving station opposite from the hopper.

18. The machine of claim 16, wherein the means for opening each sleeve is a suction head and a source of vacuum removably attachable to a top of the respective sleeve, wherein the sleeve may be opened by vacuum from the folded position.

19. A method for automatically inserting a tray of postal mail into a sleeve, the sleeve having a top, a bottom, two opposite sides therebetween and two open ends, the sides each having a height, the method comprising the steps of:

providing a transport station having a first side, a second side, a first end and a second end, the sides being substantially perpendicular to the ends;

providing a continuous transport means disposed between the sides of the transport station, providing at least one pusher means attached to the transport means such that the at least one pusher means may engage the tray;

placing the tray on the transport means at the first end of the transport station and moving said tray to the second end of the transport station;

providing a sleeving station adjacent to the second end of the transport station, the sleeving station having a base surface, a first sidewall and an opposite second sidewall, the transport means extending through the sleeving station between the sidewalls of the sleeving station, wherein the at least one pusher means advances the tray in a direction from the transport station to the sleeving station;

the first sidewall of the sleeving station being a hopper, providing a plurality of collapsed sleeves within the hopper, providing means within the hopper for dispensing the collapsed sleeves one at a time as desired, into the sleeving station, dispensing the collapsed sleeve into the sleeving station such that when dispensed from the hopper, the sleeve is received between the opposite sidewalls of the sleeving station, the base surface of the sleeving station supporting the bottom of the sleeve, the hopper supporting one of the sides of the sleeve providing a source of vacuum and a suction head interruptably connected to the source of vacuum, adjustably disposing the suction head above the sleeving station for engaging the top of the collapsed sleeve;

applying vacuum to the suction head and fully opening the collapsed sleeve;

discontinuing application of vacuum to the suction head;

advancing the tray into the opened sleeve in the sleeving station and pushing the sleeve containing the tray out of the sleeving station and sequentially repeating of the steps.

20. The method of claim 19, further comprising pivotally connecting the second sidewall of the sleeving station distal from the hopper to the base surface of the sleeving station, wherein the second sidewall extends upwardly from the base surface, means for pivoting the second sidewall of the sleeving station being connected to the sleeving station, the second sidewall pivoting outwardly from the base surface in the absence of the sleeve in the sleeving station and pivoting inwardly toward the hopper to an upright position simultaneously with the collapsed sleeve being dispensed from the hopper into the sleeving station, the second sidewall of the sleeving station contacting the other side of the sleeve and assisting in opening the sleeve.

21. The method of claim 19, further comprising pivotally mounting an arm above the sleeving station, mounting the suction head on the arm, moving the arm towards the base surface of the sleeving station permitting the suction head, with vacuum applied, to engage the top of the collapsed sleeve in the sleeving station, raising the arm away from the base surface of the sleeving station to expand the collapsed sleeve to an opened position, discontinuing the application of vacuum and moving the arm away from the opened sleeve.

22. A sleeving machine for automatically inserting a tray of postal mail into a sleeve, the sleeve having a top, bottom, two sides and two open ends, the machine comprising:

a transport station having a first side, a second side, a first end and a second end, the sides being substantially perpendicular to the ends, at least one belt means disposed between the sides of the transport station such that the tray may be moved from the first end to the second end of the transport station;

the tray having an end, said end having a midpoint;

at least one pusher means attached to the at least one belt means, the at least one pusher means having a tongue-like shape extending outwardly from the at least one belt means wherein the tongue-like shape engages and cooperates with midpoint on the end of the tray to facilitate advancement of the tray;

a pair of guides, one guide disposed on each respective side of the transport station, said guides directing the tray toward a sleeving station;

the sleeving station adjacent to the second end of the transport station, the sleeving station having a first side and an opposite second side, the at least one belt means extending through the sleeving station between the sides of the sleeving station wherein the at least one pusher means advances the tray in a direction from the transport station to the sleeving station;

a hopper adjoining the first side of the sleeving station, the hopper containing therein a plurality of collapsed sleeves, means for dispensing the collapsed sleeves one at a time as desired, into the sleeving station, means disposed solely on the second side of the sleeving station distal from the hopper for opening the collapsed sleeves, a source of vacuum, a suction head interruptably connected to the source of vacuum, the suction head being disposed above the sleeving station for engaging the top of the collapsed sleeve and for assisting in opening the sleeve, wherein the open ends of the sleeve are oriented in the direction of the movement of the tray such that the tray may be advanced by the at least one pusher means and be disposed inside the opened sleeve;

power means to drive the at least one belt means and the means for dispensing the collapsed sleeve from the hopper;

sensing means to coordinate the movement of the at least one belt means for dispensing the collapsed sleeve, to assure continuous, uninterrupted advancement of the tray and insertion of the tray into the opened sleeve, to permit the at least one pusher means to advance the sleeve containing the tray out of the sleeving station and to further permit sequential repetition by the machine.

23. In a conveyerized machine, wherein a sleeve, open at least at one end thereof, is fed from a hopper and is moved from an initial substantially-flat position into an expanded position, such that the sleeve in the expanded position thereof has a substantially rectangular cross-section including a pair of parallel sides connected by a top wall, and wherein an article or articles are inserted endwise into the sleeve through the open end thereof, the improvement being the conveyerized machine having a hopper having a sidewall for supporting one of the parallel sidewalls of the sleeve and aiding in expanding thereof, a vacuum means above the top wall of the sleeve to aid in expanding the sleeve from the substantially flat position, and a pivoted member opposite the hopper sidewall, the pivoted member being initially retracted away from the sleeve, pivoting towards the sleeve and engaging the other sidewall of the sleeve, thereby assisting in expanding the sleeve, and thereby bracing the sleeve against the sidewall of the hopper as the sleeve is expanded.

* * * * *